US007424873B2

(12) United States Patent
Ezaki et al.

(10) Patent No.: US 7,424,873 B2
(45) Date of Patent: Sep. 16, 2008

(54) VARIABLE VALVE MECHANISM

(75) Inventors: Shuichi Ezaki, Susono (JP); Toshiaki Asada, Mishima (JP); Manabu Tateno, Nagaizumi-cho (JP)

(73) Assignee: Toyota, Jidosha Kabushiki Kaisha, Toyota (JP)

( * ) Notice: Subject to any disclaimer, the term of this patent is extended or adjusted under 35 U.S.C. 154(b) by 370 days.

(21) Appl. No.: 10/555,572

(22) PCT Filed: Dec. 7, 2004

(86) PCT No.: PCT/JP2004/018539

§ 371 (c)(1),
(2), (4) Date: Nov. 4, 2005

(87) PCT Pub. No.: WO2005/059320

PCT Pub. Date: Jun. 30, 2005

(65) Prior Publication Data

US 2006/0249109 A1 Nov. 9, 2006

(30) Foreign Application Priority Data

Dec. 18, 2003 (JP) ..... 2003-420514
Feb. 19, 2004 (JP) ..... 2004-043093

(51) Int. Cl.
*F01L 1/34* (2006.01)

(52) U.S. Cl. ..... 123/90.16; 123/90.15; 123/90.17; 123/90.31

(58) Field of Classification Search ..... 123/90.16
See application file for complete search history.

(56) References Cited

U.S. PATENT DOCUMENTS 5,622,145 A * 4/1997 Hara ..... 123/90.16
6,318,317 B1 * 11/2001 Hubschle ..... 123/90.16
6,467,443 B1 * 10/2002 Tsuruta et al. ..... 123/90.16

FOREIGN PATENT DOCUMENTS

| | | |
|---|---|---|
| JP | U 2-39505 | 3/1990 |
| JP | A 6-17623 | 1/1994 |
| JP | A 7-63023 | 3/1995 |

(Continued)

*Primary Examiner*—Thomas Denion
*Assistant Examiner*—Kyle M Riddle
(74) *Attorney, Agent, or Firm*—Oliff & Berridge, PLC

(57) ABSTRACT

Disclosed is a variable valve mechanism 10 for changing the lift amount and operating angle of an internal combustion engine valve disc 12. The variable valve mechanism comprises a first cam 54, which rotates in accordance with crankshaft rotation; a transmission member 24, 38 that includes a second cam 32, 34, which oscillates in synchronism with the rotation of the first cam 54 and transmits the force exerted by the first cam 54 to the valve disc 12; a control shaft 40, which is adjusted for a predetermined rotation position; an adjustment mechanism 36, 38 for varying the lift amount and operating angle of the valve disc 12 by changing the oscillation range of the transmission member 24, 38 in accordance with the rotation position of the control shaft 40; a lost motion spring 60 for pressing the transmission member 24, 38 toward the first cam 54 to ensure that the transmission member 24, 38 remains coupled to the first cam 54; and an assist spring 64 for pressing the transmission member 24, 38 in resistance to the force exerted by the lost motion spring 60.

11 Claims, 13 Drawing Sheets

FOREIGN PATENT DOCUMENTS

| | | |
|---|---|---|
| JP | A 7-293216 | 11/1995 |
| JP | A 8-246824 | 9/1996 |
| JP | A 10-280931 | 10/1998 |
| JP | A 2000-234507 | 8/2000 |
| JP | A 2001-214765 | 8/2001 |
| JP | A 2001-263014 | 9/2001 |
| JP | A 2003-129811 | 5/2003 |

* cited by examiner

VARIABLE VALVE MECHANISM

TECHNICAL FIELD

The present invention relates to a variable valve mechanism, and more particularly to an internal combustion engine variable valve mechanism, which is capable of changing the operating angle and lift amount of a valve that opens/closes in synchronism with camshaft rotation.

BACKGROUND ART

A conventional variable valve mechanism is disclosed. The conventional variable valve mechanism is capable of changing the lift amount of a valve disc that opens/closes in synchronism with camshaft rotation. The variable valve mechanism disclosed, for instance, by Japanese Patent Laid-Open No. Hei 7-63023 is capable of changing the lift amount of a valve disc in accordance with the rotation position of an eccentric shaft. In this variable valve mechanism, a compression spring (lost motion spring) is used to push a rocker lever, which is provided with a roller, in order to ensure that a roller whose contact with a cam varies in position with the eccentric shaft rotation position is pressed against the cam. When this variable valve mechanism is employed, the compression spring works to ensure that the cam is in mechanical contact with the roller at all times.

In the conventional mechanism disclosed by Japanese Patent Laid-Open No. Hei 7-63023, however, the compression spring coordinates with a valve spring to press the roller toward the cam. As a result, the eccentric shaft receives a force that is applied in a fixed direction. Consequently, the required drive torque of an actuator for eccentric shaft rotation increases, thereby lowering the responsiveness of a variable valve or increasing the power consumption.

Another variable valve mechanism disclosed, for instance, by Japanese Patent Laid-Open No. Hei 7-293216 is capable of changing the lift amount of a valve disc of an internal combustion engine. This variable valve mechanism includes a mechanical device that is positioned between the valve disc and cam to change the lift amount. This mechanical device increases the lift amount of the valve disc when a control shaft rotates in a certain direction, and decreases the lift amount of the valve disc when the control shaft rotates in another direction. When this mechanical device is employed, the lift amount of the valve disc can be arbitrarily changed by rotating the control shaft as appropriate.

The valve disc of an internal combustion engine is generally provided with a valve spring, which pushes the valve disc in the valve closing direction. Therefore, when the conventional variable valve mechanism opens the valve disc, the valve spring's reactive force is exerted on the mechanical device between the valve disc and cam. The greater the lift amount for the valve disc, the greater the reactive force.

The mechanical device described above is dynamically stabler when the reactive force exerted on the mechanical device is small than when the reactive force exerted on the mechanical device is increased with an increase in the lift of the valve disc. Therefore, the mechanical device is generally likely to change its state to decrease the lift amount. In other words, it is likely that a reactive force for changing the mechanical device state to a state corresponding to a small lift will be transmitted to the above-mentioned control shaft.

If the above reactive force is transmitted to the control shaft to change the control shaft status, an appropriate lift amount cannot be maintained for the valve disc. Therefore, this type of variable valve mechanism needs a mechanism for maintaining the control shaft status constant without regard to the valve spring's reactive force.

The control shaft of the conventional variable valve mechanism disclosed by Japanese Patent Laid-Open No. Hei 7-293216 is driven by a motor via a gear mechanism. This gear mechanism includes a worm gear, which is installed over a motor rotation shaft, and a worm wheel, which meshes with the worm gear. The gear mechanism, which includes the worm gear and worm wheel, provides high normal efficiency and low inverse efficiency due to a great friction force exerted between the worm gear and worm wheel and a great gear ratio between them.

The above gear mechanism makes it possible to transmit a motor-generated torque to the control shaft with high efficiency and properly prevent the input to the control shaft from being transmitted to the motor. Therefore, the above conventional variable valve mechanism can accurately control the control shaft status without being affected by the valve spring. As a result, it is possible to accurately control the lift amount of the valve disc.

However, when the lift amount of the valve disc in the conventional variable valve mechanism disclosed by Japanese Patent Laid-Open No. Hei 7-293216 is to be increased, it is necessary to rotate the control shaft in resistance to a reactive force for decreasing the lift amount. More specifically, it is necessary to rotate the control shaft in the direction of increasing the lift amount in resistance to the valve spring's reactive force for decreasing the lift amount.

To meet the above requirements, it is necessary that the motor generate a great driving force. As a result, a motor cost increase, power consumption increase due to motor use, motor mountability deterioration due to structural expansion, and various other problems arise. Further, if such a great force is exerted on the control shaft, the control shaft may significantly become distorted. In addition, the transmission of such a great force increases the gear-to-gear contact load, thereby accelerating the wear of gears.

The present invention has been made to solve the above problems. It is an object of the present invention to provide an internal combustion engine variable valve mechanism for changing the lift amount and operating angle of a valve that opens/closes in synchronism with camshaft rotation, and reduce the required load on a variable valve.

DISCLOSURE OF INVENTION

According to a first aspect of the present invention, a variable valve mechanism for changing the lift amount and operating angle of an internal combustion engine valve disc comprises a first cam, which rotates in accordance with crankshaft rotation; a transmission member that includes a second cam, which oscillates in synchronism with the rotation of the first cam and transmits the force exerted by the first cam to the valve disc; a control shaft, which is adjusted for a predetermined rotation position; an adjustment mechanism for varying the lift amount and operating angle of the valve disc by changing the oscillation range of the transmission member in accordance with the rotation position of the control shaft; a lost motion spring for pressing the transmission member toward the first cam to ensure that the transmission member remains coupled to the first cam; and an assist spring for pressing the transmission member in resistance to the force exerted by the lost motion spring.

Since the assist spring is employed to press the transmission member in resistance to the force exerted by the lost motion spring, it is possible to reduce the force that is exerted on the transmission member by the lost motion spring. Therefore, it is easy to change the transmission member oscillation range. Consequently, it is possible to reduce the control shaft drive torque for oscillation range changes. As a result, the responsiveness of a variable valve improves, making it possible to instantly change the lift amount and operating angle. Further, the control shaft drive torque decreases, making it possible to use a smaller-size actuator for driving the control shaft and minimize the actuator current consumption.

According to a second aspect of the present invention, there is provided the variable valve mechanism, which is improved as described above, wherein the lost motion spring presses the transmission member in the direction of changing the lift amount and operating angle of the valve disc from a great lift/great operating angle side to a small lift/small operating angle side; and wherein the force exerted on the transmission member by the assist spring increases with a decrease in the lift amount and operating angle of the valve disc.

When the force exerted on the transmission member by the lost motion spring changes from a great lift/great operating angle side to a small lift/small operating angle side, the force exerted on the transmission member by the assist spring increases with a decrease in the lift amount/operating angle. It is therefore possible to reduce the control shaft drive torque particularly when the variable valve is operated on a small lift/small operating angle side.

According to a third aspect of the present invention, there is provided the variable valve mechanism, which is improved as described above, further comprising a valve spring for pressing the valve disc toward the transmission member, wherein the assist spring presses the transmission member in resistance to the valve spring's force that is exerted on the transmission member via the valve disc.

Since the force exerted by the assist spring resists the force exerted by the valve spring, the force exerted on the transmission member by the valve spring decreases. Therefore, the oscillation range of the transmission member can easily be changed. Consequently, it is possible to reduce the control shaft drive torque for oscillation range changes.

According to a fourth aspect of the present invention, there is provided the variable valve mechanism, which is improved as described above, further comprising an actuator for generating a driving force for changing the rotation position of the control shaft and a gear mechanism that is positioned between the actuator and the control shaft, wherein a plurality of the transmission members, which are provided for the valve discs of various cylinders, are coupled to the common control shaft; wherein the force exerted by the lost motion spring, the force exerted by the assist spring, and the force exerted by the valve spring are transmitted in the rotation direction of the control shaft via the transmission member and the adjustment mechanism; and wherein the resultant force applied in the rotation direction of the control shaft by the lost motion spring, the assist spring, and the valve spring decreases with an increase in the distance from the gear mechanism as viewed in the length direction of the control shaft.

Since the resultant force applied in the rotation direction of the control shaft decreases with an increase in the distance from the gear mechanism, the resultant force applied to various parts of the control shaft decreases with a decrease in the rigidity of the various parts of the control shaft. As a result, the degree of control shaft torsion can be minimized.

According to a fifth aspect of the present invention, there is provided the variable valve mechanism, which is improved as described above, wherein the force exerted on the transmission member by the assist spring increases with an increase in the distance from the gear mechanism as viewed in the length direction of the control shaft.

Since the force exerted on the transmission member by the assist spring increases with an increase in the distance from the gear mechanism, the assist spring load increases with a decrease in the rigidity of a part of the control shaft. A part of the control shaft that is positioned away from the gear mechanism is likely to become distorted or otherwise misshaped due to the force received from the lost motion spring or valve spring. However, the force exerted on the control shaft by the lost motion spring or valve spring is reduced by the assist spring. Therefore, the degree of control shaft torsion can be minimized.

According to a sixth aspect of the present invention, there is provided the variable valve mechanism, which is improved as described above, wherein the force exerted on the transmission member by the lost motion spring decreases with an increase in the distance from the gear mechanism as viewed in the length direction of the control shaft.

Since the force exerted on the transmission member by the lost motion spring decreases with an increase in the distance from the gear mechanism, the lost motion spring load decreases with a decrease in the rigidity of a part of the control shaft. A part of the control shaft that is positioned away from the gear mechanism is likely to become distorted or otherwise misshaped due to the force received from the lost motion spring or valve spring. However, the force exerted on the transmission member by the lost motion spring decreases with an increase in the distance from the gear mechanism. Therefore, the degree of control shaft torsion can be minimized.

According to a seventh aspect of the present invention, a variable valve mechanism, which is capable of changing the operating angle and/or lift amount of an internal combustion engine valve disc, comprises a control shaft whose status is controlled to change the operating angle and/or lift amount; an oscillation arm that is positioned between a cam and valve disc to oscillate in synchronism with cam rotation and transmit the force exerted by the cam to the valve disc; an adjustment mechanism for changing the basic relative angle of the oscillation arm relative to the valve disc in accordance with the status of the control shaft; an actuator for generating a driving force for changing the status of the control shaft; a gear mechanism that is positioned between the actuator and control shaft; and assist force generation means for applying an assist force to the gear mechanism in order to increase the operating angle and/or lift amount.

Since the status of the control shaft is controlled, the basic relative angle of the oscillation arm relative to the valve disc can be varied. As a result, the operating angle and/or lift amount of the valve disc can be varied. Further, the present invention can apply an assist force to the gear mechanism, which is positioned between the actuator and control shaft, in order to increase the operating angle and/or lift amount. In other words, the present invention can apply an assist force to the gear mechanism for the purpose of offsetting an inevitable force that is applied in the direction of decreasing the operating angle and/or lift amount. Therefore, the present invention can decrease an output, which is to be generated by the actuator for the purpose of increasing the operating angle and/or lift amount, by an amount equivalent to the assist force.

According to an eighth aspect of the present invention, there is provided the variable valve mechanism, which is improved as described above, wherein the gear mechanism includes a worm wheel and worm gear, which are interconnected so as to position the worm gear toward the actuator and the worm wheel toward the control shaft; and wherein the assist force is applied to the worm wheel or to a structure integral with the worm wheel.

The assist force to be applied to the gear mechanism can be given to the worm wheel. When the worm gear is to be rotated in the direction of increasing the operating angle and/or lift amount in this instance, it is possible to decrease a friction force that is exerted between the worm gear and worm wheel. The gear mechanism, which comprises the worm gear and worm wheel, exhibits higher normal efficiency in a stationary state when the coefficient of static friction is smaller. Therefore, the present invention makes it possible to operate the control shaft in the direction of increasing the operating angle and/or lift amount by using a sufficiently small force, beginning with actuator startup.

According to a ninth aspect of the present invention, there is provided the variable valve mechanism, which is improved as described above, further comprising a lost motion spring for pressing the oscillation arm toward the cam to ensure that the oscillation arm remains mechanically coupled to the cam, wherein the oscillation arm moves in the direction of increasing the amount of lost motion spring deformation when the generation of a great operating angle and/or lift amount is requested.

With the force generated by the lost motion spring, it is possible to ensure that the oscillation arm remains mechanically coupled to the cam. The lost motion spring generates a force in the direction of inhibiting the oscillation arm from moving in the direction of increasing the operating angle and/or lift amount. In the present invention, the assist force exerted on the gear mechanism also works to offset the force exerted by the lost motion spring. Therefore, the present invention makes it possible to changing the control shaft in the direction of increasing the operating angle and/or lift amount by applying a small force while using the lost motion spring, which has characteristics described above.

According to a tenth aspect of the present invention, there is provided the variable valve mechanism, which is improved as described above, wherein a plurality of the oscillation arms provided for the valve discs of various cylinders are coupled to the common control shaft; and wherein the force exerted by the lost motion spring decreases with an increase in the distance from the gear mechanism as viewed in the length direction of the control shaft.

Since the force exerted on the transmission member by the lost motion spring decreases with an increase in the distance from the gear mechanism, the lost motion spring load decreases with a decrease in the rigidity of a part of the control shaft. A part of the control shaft that is positioned away from the gear mechanism is likely to become distorted or otherwise misshaped due to the force received from the lost motion spring or valve spring. However, the force exerted on the transmission member by the lost motion spring decreases with an increase in the distance from the gear mechanism. Therefore, the degree of control shaft torsion can be minimized.

According to an eleventh aspect of the present invention, a variable valve mechanism for changing the lift amount and operating angle of an internal combustion engine valve disc comprises a first cam, which rotates in accordance with crankshaft rotation; a transmission member that includes a second cam, which oscillates in synchronism with the rotation of the first cam and transmits the force exerted by the first cam to the valve disc; a control shaft, which is adjusted for a predetermined rotation position; an adjustment mechanism for varying the lift amount and operating angle of the valve disc by changing the oscillation range of the transmission member in accordance with the rotation position of the control shaft; a lost motion spring for pressing the transmission member toward the first cam to ensure that the transmission member remains coupled to the first cam; and an assist spring for generating a force that resists the force exerted by the lost motion spring.

Since the assist spring is provided to generate a force that resists the force exerted by the lost motion spring, it is possible to reduce the force exerted by the lost motion spring. It is therefore possible to reduce the control shaft drive torque for transmission member oscillation range changes. As a result, the responsiveness of a variable valve improves, making it possible to instantly change the lift amount and operating angle. Further, the control shaft drive torque decreases, making it possible to use a smaller-size actuator for driving the control shaft and minimize the actuator current consumption.

BEST MODE FOR CARRYING OUT THE INVENTION

Figure 1:
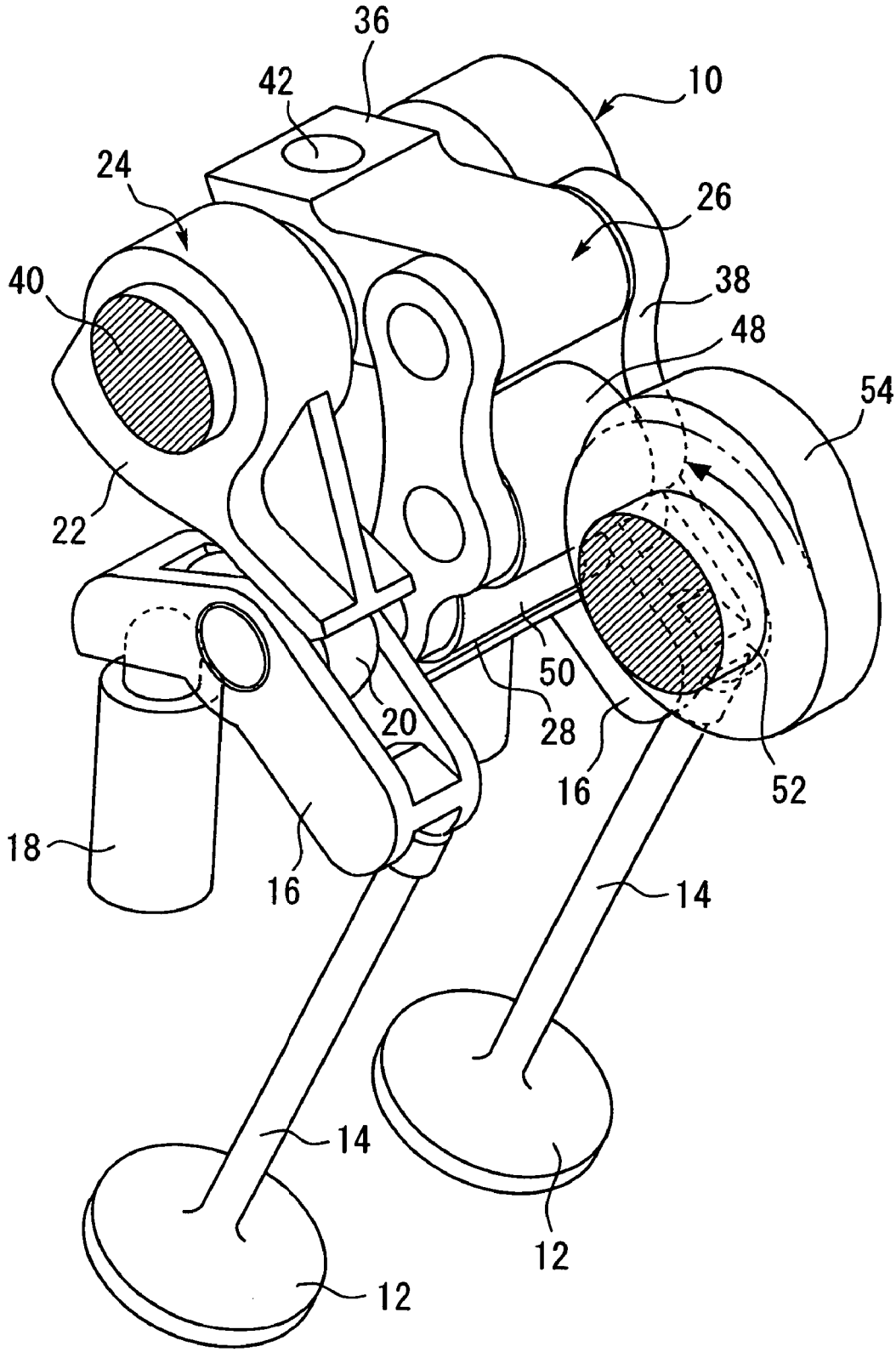
FIG. 1 is a perspective view illustrating the essential parts of a variable valve mechanism according to a first embodiment of the present invention.

Embodiments of the present invention will now be described in detail with reference to the accompanying drawings. Like elements in the drawings are designated by like reference numerals and will not be described repeatedly. The present invention is not limited to the embodiments described below.

First Embodiment

FIG. 1 is a perspective view illustrating the essential parts of a variable valve mechanism 10 according to a first embodiment of the present invention. The variable valve mechanism shown in FIG. 1 is a mechanism for driving an internal combustion engine valve disc. It is assumed that each cylinder in an internal combustion engine is equipped with two intake valves and two exhaust valves. The configuration shown in FIG. 1 functions as a mechanism for driving two intake valves or two exhaust valves that are provided for a cylinder.

The configuration shown in FIG. 1 includes two valve discs 12, which function as intake valves or exhaust valves. A valve stem 14 is fastened to each valve disc 12. The end of the valve stem 14 is in contact with a pivot that is mounted on one end of a rocker arm 16. The valve stem 14 is pressed by a valve spring 62, which will be described later. The rocker arm 16 is pressed upward by the valve stem 14, which is pressed by the valve spring 62. The other end of the rocker arm 16 is supported by a hydraulic lash adjuster 18 in a turnable manner. When the vertical position of the rocker arm 16 is automatically adjusted by means of hydraulic pressure, a tappet clearance can be automatically adjusted by the hydraulic lash adjuster 18.

A roller 20 is provided at the center of the rocker arm 16. An oscillation arm 22 is positioned over the roller 20. The structure of the oscillation arm section will now be described with reference to FIG. 2.

Figure 2:
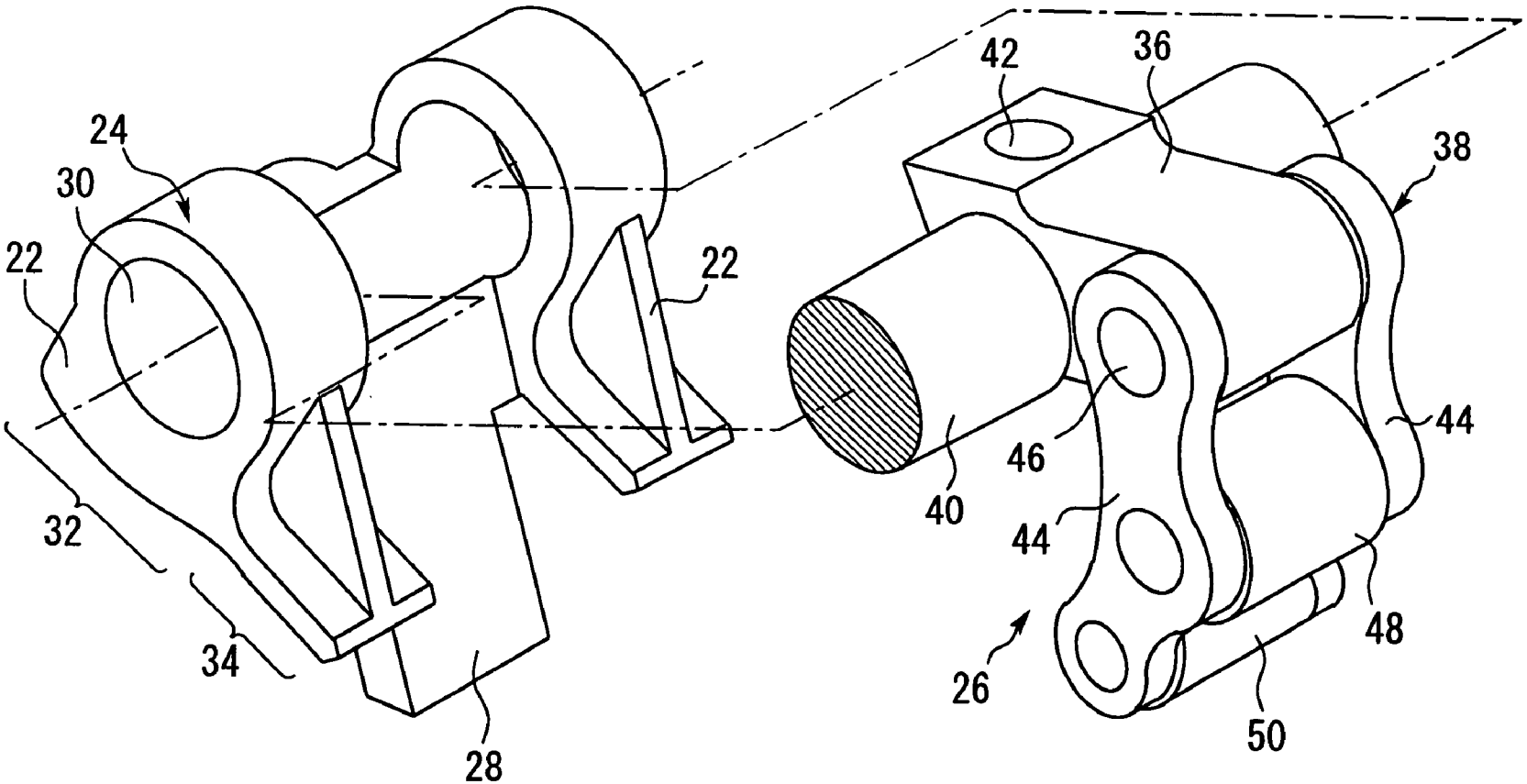
FIG. 2 is an exploded perspective view illustrating a first arm member and second arm member, which constitute the variable valve mechanism shown in FIG. 1.

FIG. 2 is an exploded perspective view illustrating a first arm member 24 and a second arm member 26. Both the first arm member 24 and second arm member 26 are major component members within the configuration shown in FIG. 1. As shown in FIG. 2, the aforementioned oscillation arm 22 is a part of the first arm member 24.

In other words, the first arm member 24 includes two oscillation arms 22 and a roller contact surface 28 which are formed integrally, as shown in FIG. 2. The roller contact surface 28 is sandwiched between the oscillation arms 22. The two oscillation arms 22 are provided respectively for the two valve discs 12 and both in contact with the aforementioned roller 20 (see FIG. 1).

The first arm member 24 is provided with a bearing section 30, which is a through-hole in the two oscillation arms 22. The surface of each oscillation arm 22 that comes into contact with the roller 20 is provided with a concentric section 32 and a pushing pressure section 34. The concentric section 32 is provided so that the surface in contact with the roller 20 is concentric with the bearing section 30. Meanwhile, the pushing pressure section 34 is provided so that its leading end is positioned farthest from the center of the bearing section 30.

The second arm member 26 is equipped with a non-oscillation section 36 and an oscillation roller section 38. The non-oscillation section 36 has a through-hole into which a control shaft 40 is inserted. Further, a lock pin 42 is inserted into the non-oscillation section 36 and control shaft 40 to lock the positional relationship between the non-oscillation section 36 and control shaft 40. Therefore, the non-oscillation section 36 and control shaft 40 function as a single structure.

The oscillation roller section 38 has two sidewalls 44. The sidewalls 44 are coupled to the non-oscillation section 36 via a rotation shaft 46 in a freely turnable manner. A cam contact roller 48 and a slide roller 50 are positioned between the two sidewalls 44. The cam contact roller 48 and slide roller 50 can turn freely while they are sandwiched between the sidewalls 44.

The aforementioned control shaft 40 is a member that is retained by the bearing section 30 of the first arm member 24 in a turnable manner. In other words, the control shaft 40 is a member that should be integral with the non-oscillation section 36 while it is retained by the bearing section 30 in a rotatable manner. To meet this requirement, the non-oscillation section 36 (that is, the second arm member 26) is positioned between the two oscillation arms 22 of the first arm member 24 before being fastened to the control shaft 40. After this positional adjustment is made, the control shaft 40 is allowed to penetrate through the two bearing sections 30 and non-oscillation section 36. The lock pin 42 is then inserted to secure the control shaft 40 and non-oscillation section 36. As a result, the first arm member 24 is allowed to freely turn on the control shaft 40. Further, the non-oscillation section 36 becomes integral with the control shaft 40 to form a mechanism in which the oscillation roller section 38 can oscillate in relation to the non-oscillation section 36.

When the first arm member 24 and second arm member 26 are assembled together as described above, the slide roller 50 of the oscillation roller section 38 can come into contact with the roller contact surface 28 of the first arm member 24 as far as predefined conditions are satisfied by the relative angle between the first arm member 24 and control shaft 40, that is, the relative angle between the first arm member 24 and non-oscillation section 36. When the first arm member 24 turns on the control shaft 40 within a range within which the predefined conditions are met while the contact between the slide roller 50 and roller contact surface 28 is maintained, the slide roller 50 can roll along the roller contact surface 28. The variable valve mechanism according to the present embodiment opens/closes the valve disc 12 while the slide roller 50 rolls along the roller contact surface 28. The valve disc operation will be described in detail later with reference to FIGS. 3A, 3B and FIGS. 4A, 4B.

FIG. 1 shows the first arm member 24, second arm member 26, and control shaft 40, which are assembled together in the sequence described above. In the resultant state, the positions of the first arm member 24 and second arm member 26 are regulated by the position of the control shaft 40. The control shaft 40 is fastened to a cylinder head or other fixed member via a bearing, which is not shown, in such a manner as to meet the aforementioned conditions, that is, to bring the roller 20 of the rocker arm 16 into contact with the oscillation arm 22.

As described later, an actuator (motor 66) is coupled to the control shaft 40. This actuator can pivot the control shaft 40 within a predetermined angular range. FIG. 1 shows a state in which the rotation angle of the control shaft 40 is adjusted by the actuator so as to meet the aforementioned predefined conditions and bring the slide roller 50 into contact with the roller contact surface 28.

The variable valve mechanism 10 according to the present embodiment is equipped with a camshaft 52, which rotates in synchronism with a crankshaft. A cam 54, which is provided for each internal combustion engine cylinder, is fastened to the camshaft 52. In a state shown in FIG. 1, the cam 54 is in contact with the cam contact roller 48 and regulates the upward motion of the oscillation roller section 38. In other words, in the state shown in FIG. 1, the roller contact surface 28 of the first arm member 24 is mechanically coupled to the cam 54 via the cam contact roller 48 of the oscillation roller section 38 and the slide roller 50.

When, in the state described above, a cam nose applies pressure to the cam contact roller 48 during the rotation of the cam 54, the pressure is transmitted to the roller contact surface 28 via the slide roller 50. The slide roller 50 can continuously transmit the force exerted by the cam 54 to the first arm member 24 while rolling over the roller contact surface 28. As a result, the first arm member 24 rotates around the control shaft 40, causing the oscillation arm 22 to depress the rocker arm 16 and moving the valve disc 12 in the valve opening direction. As described above, the variable valve mechanism 10 operates the valve disc 12 by transmitting the force exerted by the cam 54 to the roller contact surface 28 via the cam contact roller 48 and slide roller 50.

The operation of the variable valve mechanism 10 according to the first embodiment of the present invention will now be described with reference to FIGS. 3A, 3B, 4A, and 4B. As described earlier, the variable valve mechanism 30 drives the valve disc 12 by mechanically transmitting the force exerted by the cam 54 to the roller contact surface 28. To allow the variable valve mechanism 10 to operate the valve disc 12 properly, it is necessary to ensure that the cam 54 is mechanically coupled to the roller contact surface 28 via the cam contact roller 48 and slide roller 50. To meet this requirement, it is necessary to press the roller contact surface 28, that is, the first arm member 24, toward the cam 54. A lost motion spring 60, which is shown in FIGS. 3A, 3B, 4A, and 4B, is used to press the roller contact surface 28 toward the cam 54. The valve spring 62 shown in FIGS. 3A, 3B, 4A, and 4B is used to press the valve disc 12 and rocker arm 16 in the valve closing direction as described earlier.

The upper end of the lost motion spring 60 is fastened to a cylinder head or the like. The lower end of the lost motion spring 60 presses the trailing end of the oscillation arm 22, which is opposite the side on which the roller contact surface 28 is provided. In this state, therefore, the lost motion spring 60 generates a force that lifts up the roller contact surface 28 of the oscillation arm 22 (a force for rotating the oscillation arm 22 counterclockwise around the control shaft 40 in FIGS. 3A, 3B, 4A, and 4B). This force causes the roller contact surface 28 to push the slide roller 50 upward and presses the cam contact roller 48 against the cam 54 (see FIGS. 1 and 2). As a result, the variable valve mechanism 10 ensures that the cam 54 remains mechanically coupled to the roller contact surface 28 as indicated in FIG. 1.

Figure 3B:
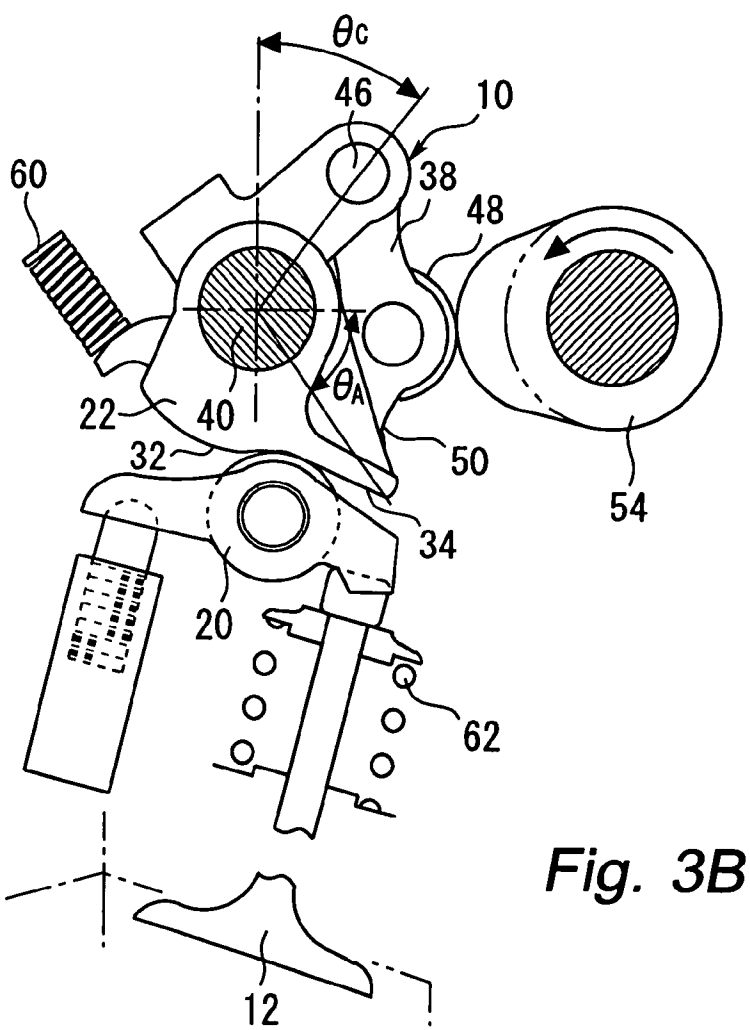
FIGS. 3A and 3B illustrate a small lift operation that is performed by the variable valve mechanism according to the first embodiment of the present invention.
Figure 3A:
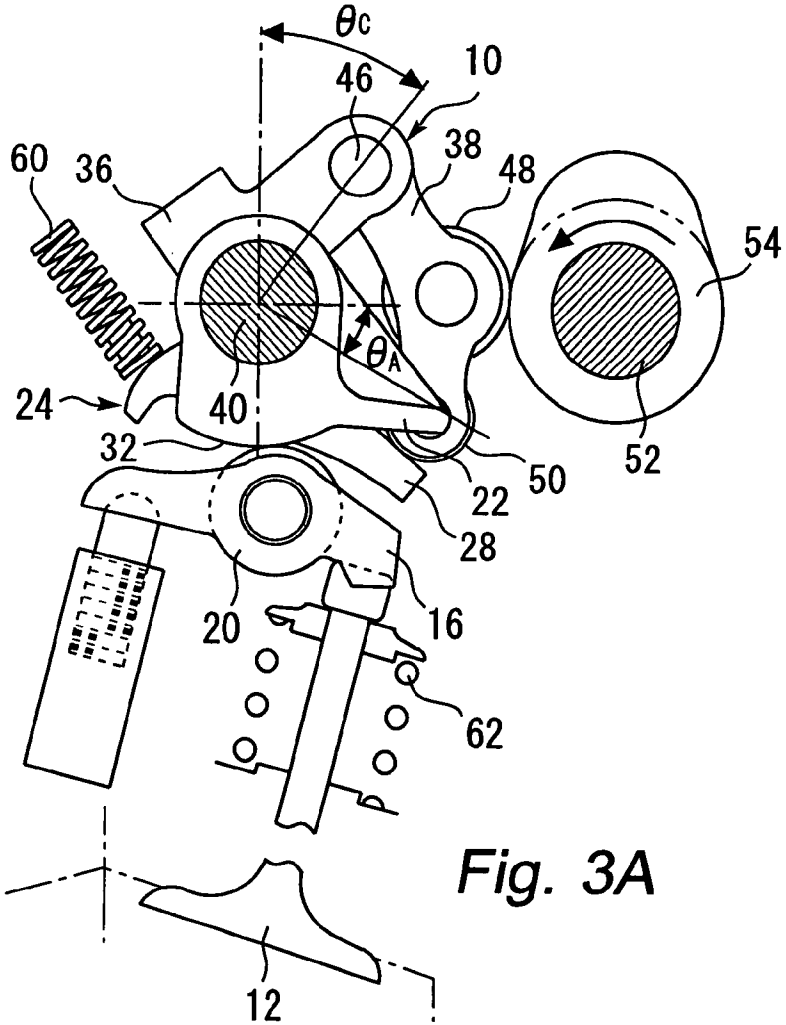

FIGS. 3A and 3B illustrate an operation that the variable valve mechanism 10 performs to give a small lift to the valve disc 12. This operation is hereinafter referred to as a "small lift operation." More specifically, FIG. 3A indicates that the valve disc 12 closes during a small lift operation, and FIG. 3B indicates that the valve disc 12 opens during a small lift operation.

In FIG. 3A, the symbol $\theta_C$ denotes a parameter that indicates the rotation position of the control shaft 40. This parameter is hereinafter referred to as the "control shaft rotation angle $\theta_C$." For the sake of simplicity, it is defined that the control shaft rotation angle $\theta_C$ is an angle between the vertical and a straight line joining the center of the control shaft 40 to the center of the rotation shaft 46. In FIG. 4A, the symbol $\theta_A$ denotes a parameter that indicates the rotation position of the oscillation arm 22. This parameter is hereinafter referred to as the "arm rotation angle $\theta_A$." For the sake of simplicity, it is defined that the arm rotation angle $\theta_A$ is an angle between the horizontal and a straight line joining the leading end of the oscillation arm 22 to the center of the control shaft 40.

In the variable valve mechanism 10, the rotation position of the oscillation arm 22, that is, the arm rotation angle $\theta_A$, is determined by the position of the slide roller 50. The position of the slide roller 50 is determined by the position of the rotation shaft 46 in the oscillation roller section 38 and the position of the cam contact roller 48. Within a range within which the cam contact roller 48 is in contact with the cam 54, the position of the slide roller 50 moves upward as the rotation shaft 46 rotates counterclockwise in FIGS. 4A and 4B, that is, as the control shaft rotation angle $\theta_C$ decreases. In the variable valve mechanism 10, therefore, the smaller the control shaft rotation angle $\theta_C$, the smaller the arm rotation angle $\theta_A$.

In the state shown in FIG. 3A, the control shaft rotation angle $\theta_C$ is virtually minimized within a range within which the cam contact roller 48 is in contact with the cam 54, that is, the cam 54 can regulate the upward motion of the cam contact roller 48. In the state indicated in FIG. 3A, therefore, the arm rotation angle $\theta_A$ is virtually minimized. The variable valve mechanism 10 is configured so that the approximate center of the concentric section 32 of the oscillation arm 22 is in contact with the roller 20 of the rocker arm 16 in the above instance. As a result, the valve disc 12 closes. The arm rotation angle $\theta_A$ prevailing in the above instance is hereinafter referred to as the "small lift reference arm rotation angle $\theta_{A0}$." As described later, the rotation angle of the control shaft 40 is locked to a value that is selected by the actuator.

When the cam 54 rotates in the state shown in FIG. 3A, the cam contact roller 48 moves toward the control shaft 40 as it is pressed by the cam nose as indicated in FIG. 3B. The distance between the slide roller 50 and the rotation shaft 46 of the oscillation roller section 38 does not change. Therefore, when the cam contact roller 48 approaches the control shaft 40, the roller contact surface 28 is depressed by the slide roller 50, which rolls over the roller contact surface 28. As a result, the oscillation arm 22 rotates in the direction of increasing the arm rotation angle $\theta_A$ so that the point of contact between the oscillation arm 22 and roller 20 moves from the concentric section 32 to the pushing pressure section 34.

When the pushing pressure section 54 comes into contact with the roller 40 in accordance with the rotation of the oscillation arm 42, the valve disc 12 moves in the valve opening direction in resistance to the force exerted by the valve spring 62. The maximum lift amount is given to the valve disc 12 when the arm rotation angle $\theta_A$ is maximized. When a small lift operation is performed, the reference arm rotation angle $\theta_{A0}$ is set to a small value as described above. Therefore, the maximum value of the arm rotation angle $\theta_A$ prevailing during the rotation of the cam 54 is relatively small for a small lift operation. The maximum arm rotation angle prevailing during a small lift operation is hereinafter referred to as the "small lift maximum arm rotation angle $\theta_{AMAX}$." The maximum lift is given to the valve disc 12 when the arm rotation angle $\theta_A$ is maximized so that the maximum arm rotation angle $\theta_{AMAX}$ prevails. As indicated in FIG. 3B, the variable valve mechanism 10 is configured so that when the small lift maximum arm rotation angle $\theta_{AMAX}$ prevails, the point of contact between the roller 20 and oscillation arm 22 slightly moves into the pushing pressure section 34, thereby giving a slight lift to the valve disc 12. Therefore, when the small lift operation described above is performed, the variable valve mechanism 10 gives a small lift to the valve disc 12 in synchronism with the rotation of the cam 54.

In the above instance, the period during which the force exerted by the cam 54 actually depresses the valve disc 12, that is, the period during which the valve disc 12 is not closed due to the rotation of the cam 54 (crank angular width), is relatively short (this period is hereinafter referred to as the "operating angle"). Therefore, when a small lift operation is performed, the variable valve mechanism 10 decreases both the lift amount and operating angle of the valve disc 12. In such an instance, a relatively small valve spring reactive force is exerted on the oscillation arm 22 when the valve disc 12 opens.

Figure 4B:
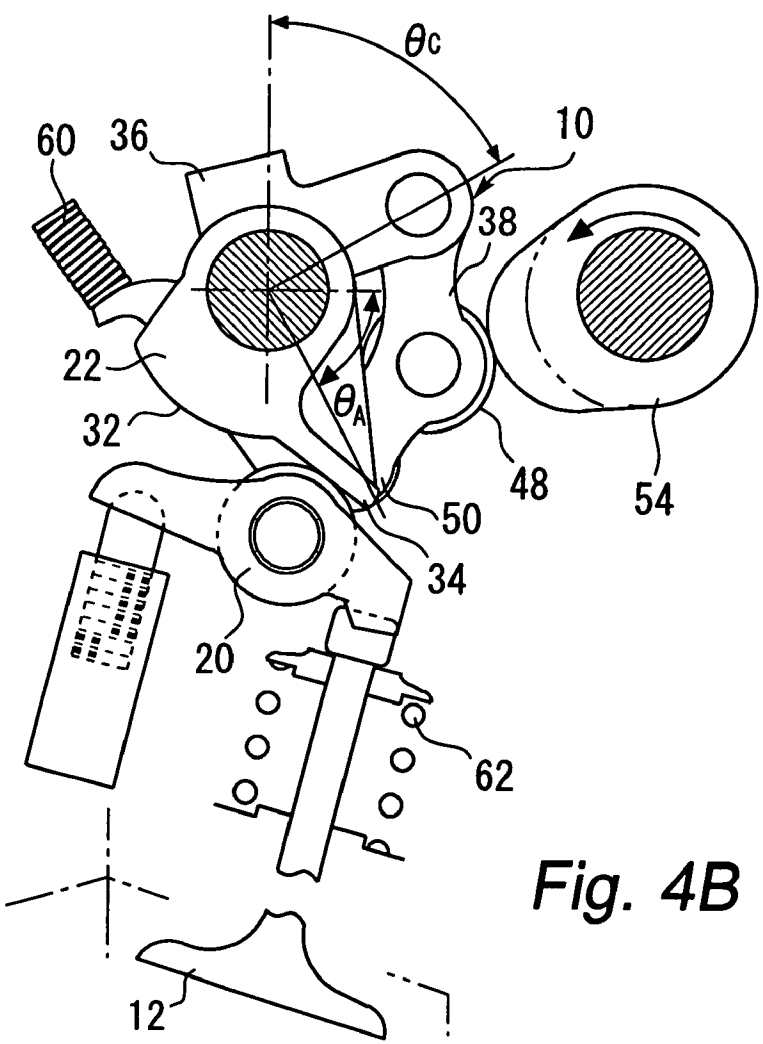
FIGS. 4A and 4B illustrate a great lift operation that is performed by the variable valve mechanism according to the first embodiment of the present invention.
Figure 4A:
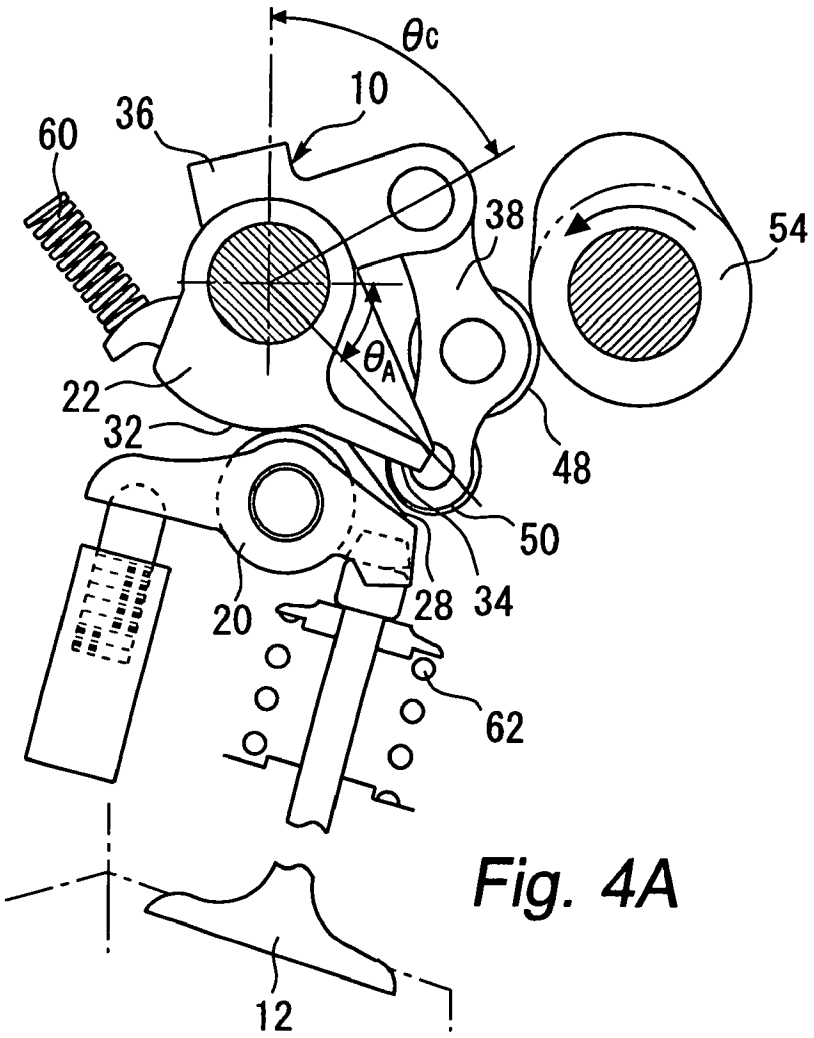

FIGS. 4A and 4B illustrate an operation that the variable valve mechanism 10 performs to give a great lift to the valve disc 12. This operation is hereinafter referred to as a "great lift operation." More specifically, FIG. 4A indicates that the valve disc 12 closes during a great lift operation, and FIG. 4B indicates that the valve disc 12 opens during a great lift operation.

When a great lift operation is to be performed, the control shaft rotation angle $\theta_C$ is adjusted for a sufficiently great value as indicated in FIG. 4A. As a result, when a great lift operation is performed, the arm rotation angle $\theta_A$ prevailing during a non-lift period, that is, the reference arm rotation angle $\theta_{A0}$, becomes a sufficiently great value within a range within which the slide roller 50 does not leave the roller contact surface 28. The variable valve mechanism 10 is configured so that the point of contact between the oscillation arm 22 and roller 20 is positioned at the end of the concentric section 32 when the reference arm rotation angle $\theta_{A0}$ prevails. Therefore, the valve disc 12 also remains closed when a great lift operation is performed.

When the cam 54 rotates in the state shown in FIG. 4A, the cam contact roller 48 is pressed by the cam nose as indicated in FIG. 4B. The oscillation arm 22 then rotates in the direction of increasing the arm rotation angle $\theta_A$. As a result, the point of contact between the oscillation arm 22 and roller 20 moves from the concentric section 32 to the pushing pressure section 34, thereby moving the valve disc 12 in the valve opening direction in resistance to the reactive force exerted by the valve spring 62. When a great lift operation is performed, the reference arm rotation angle $\theta_{A0}$ becomes a great value as described above. Therefore, the maximum arm rotation angle $\theta_{AMAX}$, which arises when the cam 54 rotates, also becomes a great value. The variable valve mechanism 10 is configured so that when the maximum arm rotation angle $\theta_{AMAX}$ arises, the point of contact between the roller 20 and oscillation arm 22 is sufficiently inserted into the pushing pressure section 34 as indicated in FIG. 4B. Therefore, while the great lift operation described above is being performed, the variable valve mechanism 10 can give a great lift and great operating angle to the valve disc 12 in synchronism with the rotation of the cam 54 as indicated in FIG. 4B. Since the lift amount for the valve disc 12 is great in this instance, a relatively great valve spring reactive force is exerted on the oscillation arm 22 when the valve disc 12 opens.

The reactive force, which is exerted by the valve spring 62 when the valve disc 12 opens, presses the oscillation arm 22 in the direction of decreasing the arm rotation angle $\theta_A$. In other words, this reactive force moves the control shaft 40 in the direction of decreasing the control shaft rotation angle $\theta_C$. In the variable valve mechanism 10, the reactive force generated by the valve spring 62 works to rotate the control shaft 40 in the direction of decreasing the operating angle and lift amount.

In the variable valve mechanism 10, the force of the lost motion spring 60 and the aforementioned reactive force of the valve spring 62 are both exerted on the control shaft 40. This exerted force by the lost motion spring 60 also works in the direction of decreasing the control shaft rotation angle $\theta_C$, that is, in the direction of decreasing the operating angle and lift amount of the valve disc 12, as is the case with the reactive force of the valve spring 62.

The force exerted by the lost motion spring 62 increases with an increase in the amount of its deformation. In the present embodiment, the amount of deformation increases as the first arm member 24 rotates in the direction of increasing the arm rotation angle $\theta_A$. Further, the present embodiment is configured so that the arm rotation angle $\theta_A$ increases with an increase in the lift amount generated for the valve disc 12. When the valve disc 12 exhibits the maximum lift during a great lift operation in the variable valve mechanism 10, the lost motion spring 62 generates a particularly great force (see the status of the lost motion spring 60 in FIG. 4B). As a result, a particularly great torque is applied to operate the control shaft 40 in the direction of decreasing the lift amount.

As described above, the variable valve mechanism 10 according to the present embodiment changes the control shaft rotation angle $\theta_C$ to change the reference arm rotation angle $\theta_{A0}$, thereby changing the operating angle and lift amount to be given to the valve disc 12.

Figure 5:
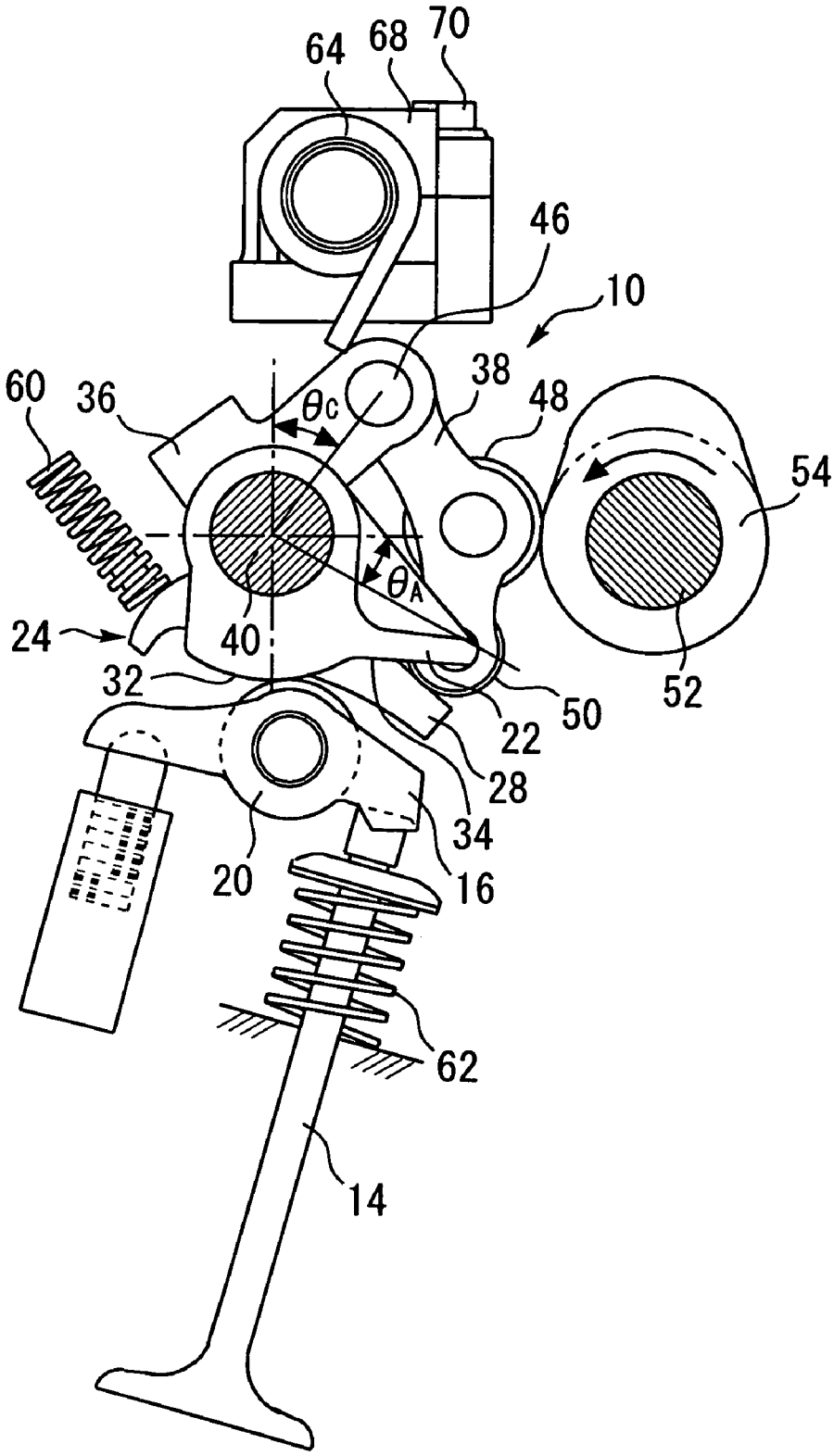
FIG. 5 is a schematic diagram illustrating the essential parts of the variable valve mechanism according to the first embodiment of the present invention.

The essential parts of the variable valve mechanism 10 according to the present embodiment will now be described with reference to FIG. 5. As described earlier, the lost motion spring 60 generates a force for lifting up the roller contact surface 28 of the oscillation arm 22. As indicated in FIG. 5, an upward force, which is generated by the valve spring 62, is exerted on the valve stem 14. The valve stem 14, which receives the force of the valve spring 62, pushes the rocker arm 16 upward. When the roller 20 of the rocker arm 16 is in contact with the pushing pressure section 34 depending on the rotation position of the cam 54, the force of the valve spring 62 also works to lift up the roller contact surface 28.

Therefore, the force of the lost motion spring 60 and the force of the valve spring 62 both works in the same direction as the rotation direction of the oscillation arm 22. These two springs operate so that the force exerted on the oscillation arm 22 works in the direction of lifting up the roller contact surface 28 (in the direction of rotating the oscillation arm 22 counterclockwise in FIG. 5). The force for lifting up the roller contact surface 28 is transmitted to the non-oscillation section 36 via the slide roller 50, oscillation roller section 38, and rotation shaft 46. The non-oscillation section 36 and the control shaft 40, which is integral with the non-oscillation section 36, then receive a force for counterclockwise rotation around the control shaft 40 in FIG. 5.

Therefore, when the control shaft 40 rotates in the direction of decreasing the control shaft rotation angle $\theta_C$, that is, when the control shaft 40 rotates from the great lift operation side to the small lift operation side, the direction in which the force of the lost motion spring 60 and the force of the valve spring 62 affect the rotation of the control shaft 40 is the same as the rotation direction of the control shaft 40. Therefore, the torque for rotating the control shaft 40 is relatively small.

When, on the other hand, the control shaft 40 rotates from the small lift operation side to the great lift operation side, the direction in which the force of the lost motion spring 60 and the force of the valve spring 62 affect the rotation of the control shaft 40 is opposite the rotation direction of the control shaft 40. Therefore, a great torque is required for rotating the control shaft 40.

Under the above circumstances, the variable valve mechanism 10 according to the present invention includes an assist spring 64, which exerts a force in the direction opposite the direction in which the force of the lost motion spring 60 and the force of the valve spring 62 are exerted, as shown in FIG. 5. The assist spring 64 comprises a torsion spring that is appropriate for space saving. When the assist spring 64 is compressed, one of its ends comes into contact with an upper surface near the rotation shaft 46 of the non-oscillation section 36. The other end is fixed. Thus, the force of the assist spring 64 works in the direction of rotating the control shaft 40 clockwise in FIG. 5. Consequently, the force exerted on the control shaft 40 by the assist spring 64 is oriented in the direction opposite the direction in which the force of the lost motion spring 60 and the force of the valve spring 62 affect the rotation of the control shaft 40.

The torque required for rotating the control shaft 40 clockwise in FIG. 5 can then be reduced. Thus, the control shaft drive torque required particularly for switching from the small lift operation side to the great lift operation side can be reduced. It is therefore possible to drive the control shaft 40 quickly. Further, since the drive torque is reduced, the power consumption for the actuator, which drives the control shaft 40, can be minimized.

Figure 6B:
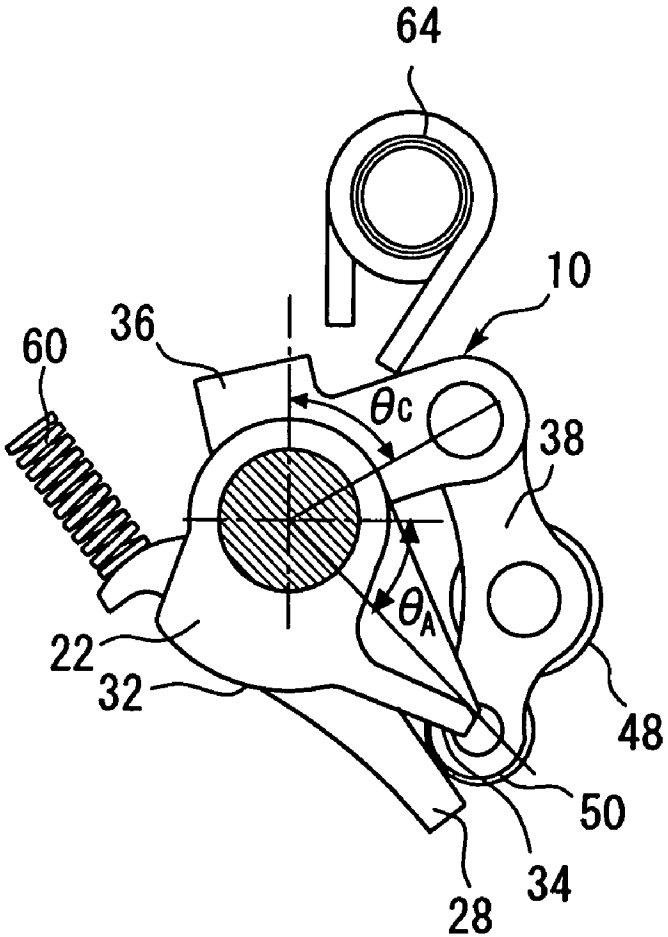
FIGS. 6A and 6B are schematic diagrams illustrating the status of an assist spring that prevails when a control shaft rotation angle $\theta_C$ is changed.
Figure 6A:
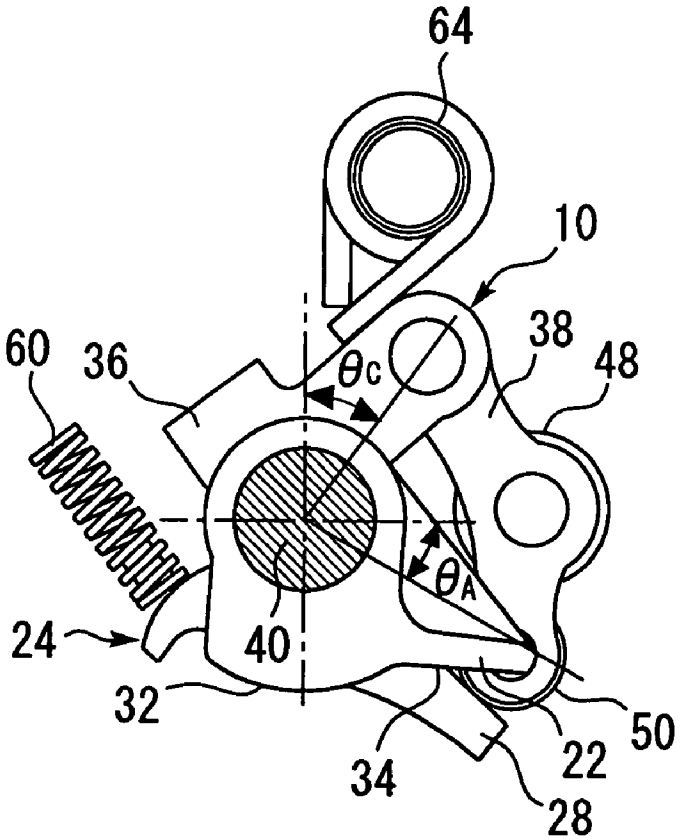

FIGS. 6A and 6B are schematic diagrams illustrating the status of the assist spring 64 that prevails when the control shaft rotation angle $\theta_C$ is changed. FIG. 6A shows a case where the control shaft rotation angle $\theta_C$ is set for the small lift operation side (small operating angle side), whereas FIG. 6B shows a case where the control shaft rotation angle $\theta_C$ is set for the great lift operation side (great operating angle side).

When the control shaft rotation angle $\theta_C$ is set for the small lift operation side as indicated in FIG. 6A, the control shaft rotation angle $\theta_C$ is minimized so that the assist spring 64 is compressed to the maximum extent. In this state, the force of the assist spring 64 becomes maximized and works to rotate the control shaft 40 clockwise. Therefore, the force of the lost motion spring 60 and the force of the valve spring 62 are offset. Thus, the drive torque required for rotating the control shaft 40 toward the great lift operation side (great operating angle side) decreases. Consequently, it is possible to quickly switch from the small operating angle/small lift state to the great operating angle/great lift state when the vehicle is to be started or accelerated in an idling or steady driving state of engine. As a result, the drivability prevailing at the time of vehicle startup/acceleration can be improved.

When, on the other hand, the control shaft rotation angle $\theta_C$ is set for the great lift operation side as indicated in FIG. 6B, the control shaft rotation angle $\theta_C$ is maximized so that the force exerted on the control shaft 40 by the assist spring 64 is reduced. Further, the force of the lost motion spring 60 and the force of the valve spring 62 work in the direction of rotating the control shaft 40 counterclockwise. Therefore, the control shaft drive torque for switching from the current state to the small lift operation side is minimized. As a result, the operating angle/lift amount can be quickly changed with a small drive torque on the great lift operation side as well.

Figure 7:
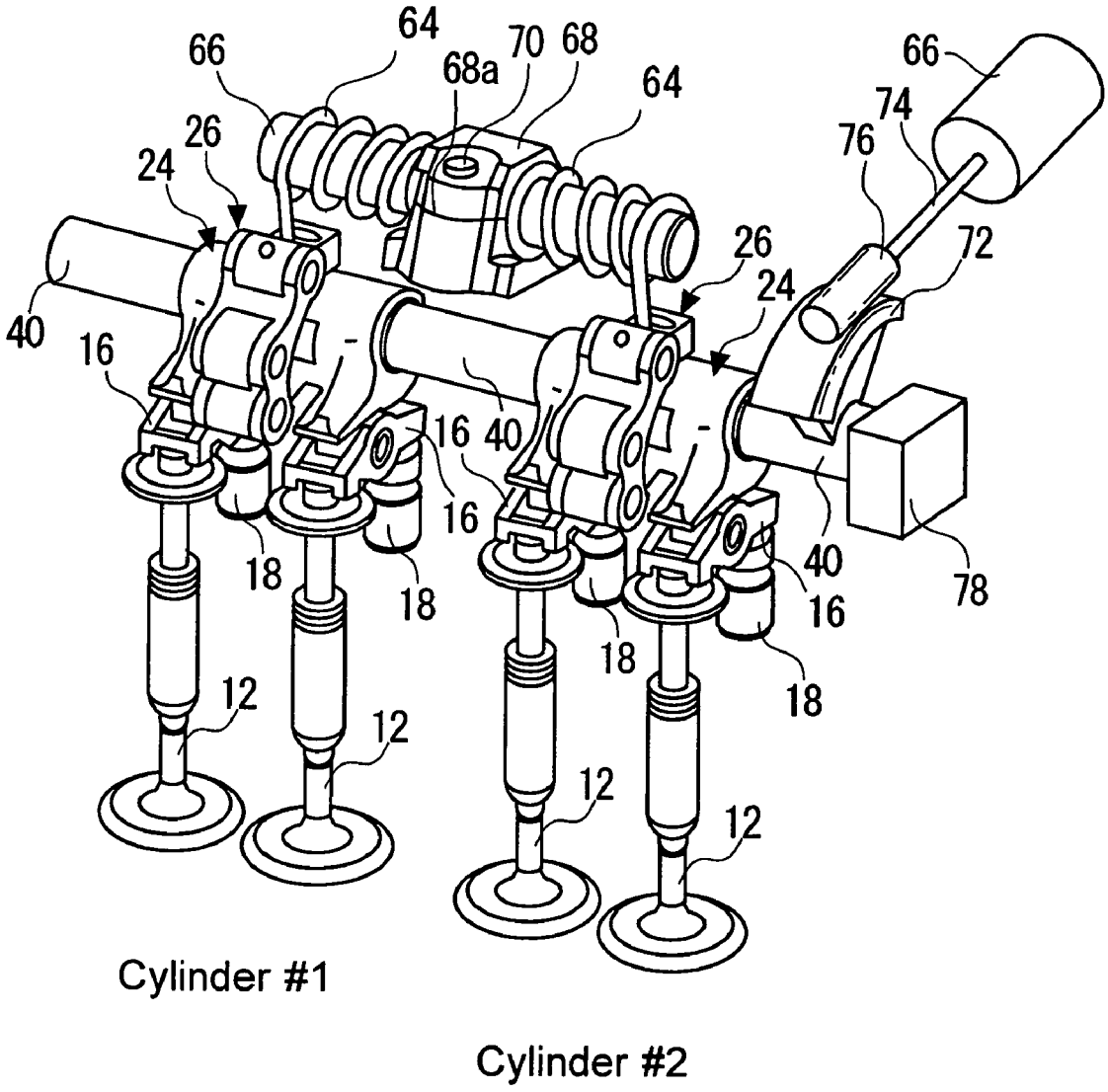
FIG. 7 is a schematic diagram illustrating an assist spring layout and control shaft rotation mechanism.

FIG. 7 is a schematic diagram illustrating an assist spring layout and control shaft rotation mechanism. As indicated in FIG. 7, the variable valve mechanism 10 includes a mechanism for rotating the control shaft 40. FIG. 7 shows two cylinders (cylinders #1 and #2). Each cylinder is equipped with two valve discs 12, which serve as intake or exhaust valves.

As shown in FIG. 7, the control shaft 40 is provided with a spring guide 66, which retains the assist spring 64. The spring guide 66 is positioned over the control shaft 40. The spring guide 66 comprises a bar member or tubular member, which are shared by two adjacent cylinders, and is fastened to a spring guide head 68. The spring guide head 68 is fastened, for instance, to the cylinder head or a cap that supports the control shaft 40 in a rotatable manner.

Two cylinder assist springs 64 are wound around the spring guide 66. One end of each assist spring 64 is fixed by inserting it into a hole in a spring guide cap 68. The other end of each assist spring 64 is in contact with the non-oscillation section 36 of the second arm member 26 and used to press the non-oscillation section 36.

The spring guide cap 68 is provided with a slit 68*a*, a bolt 70 is inserted into the spring guide cap 68. The bolt 70 is fastened, for instance, to the cylinder head or a cap that supports the control shaft 40 in a rotatable manner. This ensures that the spring guide cap 68 is fastened, for instance, to the cylinder head, and that the spring guide 66 is fastened to the spring guide cap 68.

The end of the control shaft 40 is provided with a worm wheel 72. A motor 66 for driving the control shaft 40 is installed near the worm wheel 72. A motor shaft 74 for the motor 66 is provided with a worm gear 76. The worm wheel 72 is in engagement with the worm gear 76. Therefore, when the motor shaft 74 rotates, the engagement between the worm gear 76 and worm wheel 72 causes the control shaft 40 to rotate. A position sensor 78 is mounted on the end of the control shaft 40 to detect the rotation angle of the control shaft 40.

In a mechanism for allowing the engagement between the worm wheel 72 and worm gear 76 to rotate the control shaft 40, the self-lock function of a worm gear mechanism is used as indicated in FIG. 7 to maintain the rotation angle of the control shaft 40 as specified. In such a worm gear mechanism, gear tooth surfaces slide against each other. Therefore, the static friction coefficient for the gear tooth surfaces is great so that the contact load on the gear tooth surfaces significantly affects the drive torque. Consequently, when only the forces of the lost motion spring 60 and valve spring 62 work in the rotation direction of the control shaft 40, the contact load on the gear tooth surfaces increases, thereby increasing the torque for driving the worm gear 76. Since the present embodiment is provided with the assist spring 64, it minimizes the contact load on the gear tooth surfaces of the worm wheel 72 and worm gear 76. It is therefore possible to considerably decrease the drive torque of the control shaft 40, particularly the startup torque.

Figure 8:
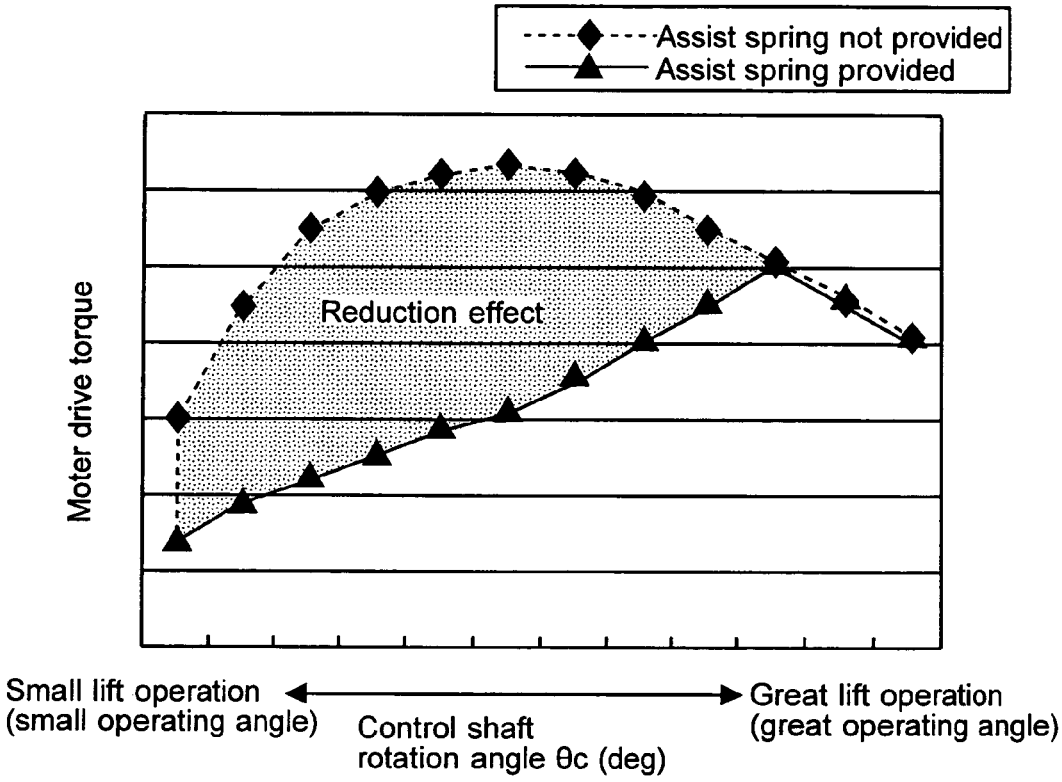
FIG. 8 is a characteristic diagram indicating that a motor drive torque is reduced by the use of an assist spring.

FIG. 8 is a characteristic diagram indicating that the drive torque of the motor 66 is reduced by the use of the assist spring 64. The horizontal axis of the diagram indicates the control shaft rotation angle $\theta_C$ (deg), whereas the vertical axis indicates the drive torque of the motor 66. The characteristic curves indicated in FIG. 8 prevail when the control shaft 40 is rotated from the small lift operation side to the great lift operation side.

The characteristic curve indicated by a broken line in FIG. 8 prevails when the assist spring 64 is not provided. In such a situation, only the forces of the lost motion spring 60 and valve spring 62 work in the direction of rotating the control shaft 40. Therefore, the drive torque for rotating the control shaft 40 from the small lift operation side to the great lift operation side increases.

The characteristic curve indicated by a solid line in FIG. 8 prevails when the assist spring 64 is provided. In such a situation, the assist spring 64 offsets the forces of the lost motion spring 60 and valve spring 62. The drive torque of the control shaft 40 can therefore be reduced to approximately one-third to one-half. Even when the assist spring 64 is provided, the drive torque for switching from the great lift operation side to the small lift operation side hardly increases. The reason is that a drive torque decrease, which is encountered when the assist spring 64 is provided, is mainly caused by a decrease in the contact load on the gear tooth surfaces of the worm gear mechanism. Therefore, it is preferred that the force of the assist spring 64 be adequate for reducing the contact load on the gear tooth surfaces of the worm gear mechanism.

As described above, the first embodiment is provided with the assist spring 64, which exerts a force in the direction opposite the direction in which the forces of the lost motion spring 60 and valve spring 62 are exerted. It is therefore possible to considerably decrease the driving force for rotating the control shaft 40. The responsiveness for driving the control shaft 40 can then be enhanced to quickly change the valve lift amount and operating angle in accordance with operating conditions. Further, the contact load on the gear tooth surfaces of the worm gear mechanism for driving the control shaft 40 can be considerably decreased to control the wear of the gear tooth surfaces. Furthermore, the size of the motor 76 for driving the control shaft 40 can be reduced to minimize the power consumption of the motor 76.

In the first embodiment, which has been described above, the first arm member 24 and oscillation roller section 38 correspond to the "transmission member" according to the first or eleventh aspect of the present invention; the non-oscillation section 36 and oscillation roller section 38 correspond to the "adjustment mechanism" according to the first or eleventh aspect of the present invention; the cam 54 corresponds to the "first cam" according to the first or eleventh aspect of the present invention; and the concentric section 32 and pushing pressure section 34 correspond to the "second cam" according to the first or eleventh aspect of the present invention.

Second Embodiment

Figure 9:
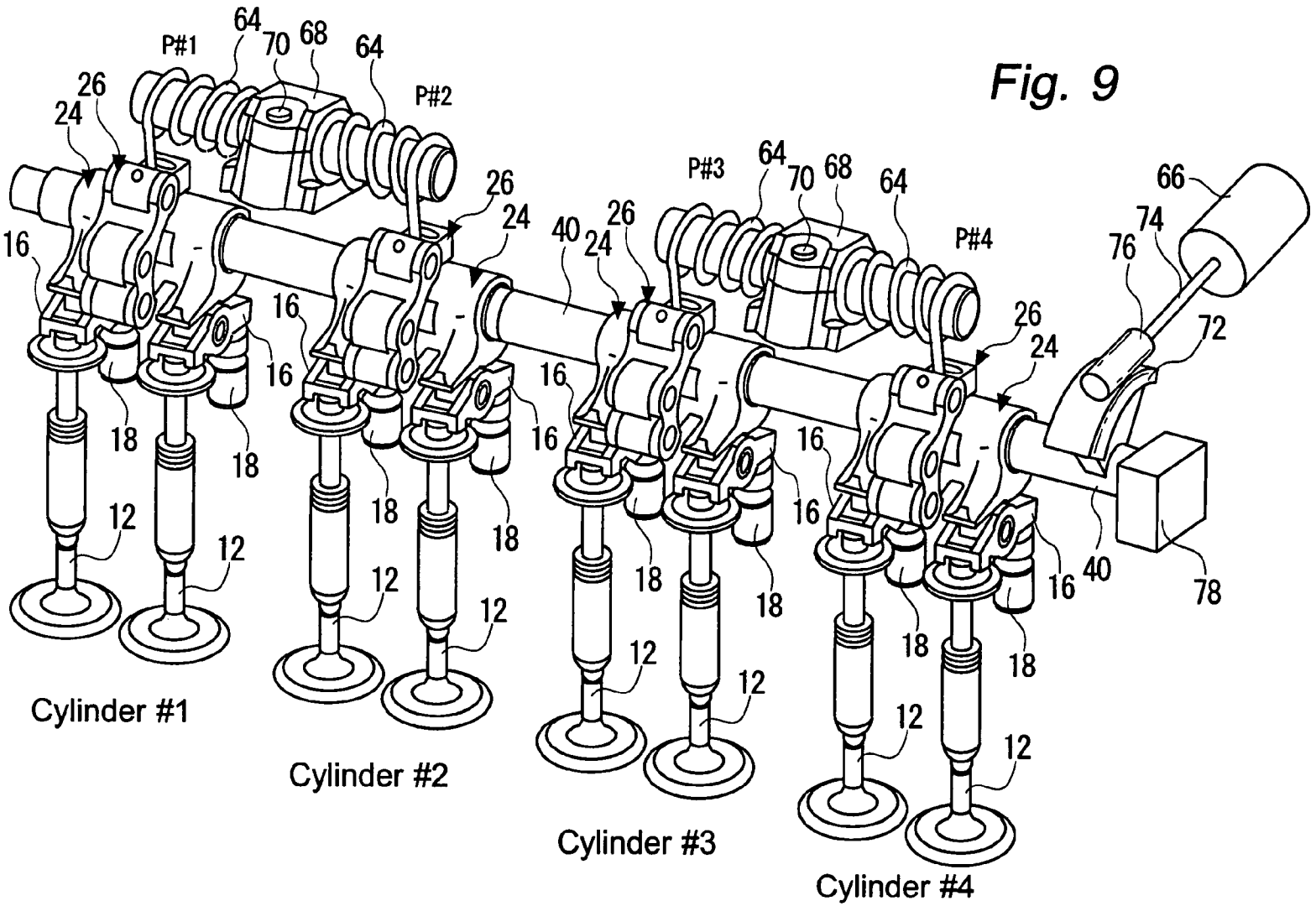
FIG. 9 is a schematic diagram illustrating a variable valve mechanism according to a second embodiment of the present invention.

A second embodiment of the present invention will now be described. FIG. 9 is a schematic diagram illustrating a variable valve mechanism 10 according to the second embodiment. The second embodiment of the variable valve mechanism 10 has the same basic configuration as the first embodiment.

As is the case with the first embodiment, each of cylinders #1 to #4 is provided with the assist spring 64 for decreasing the drive torque of the control shaft 40. In the second embodiment, different force settings are employed for the assist springs 64 in consideration of control shaft deformation.

As described in conjunction with the first embodiment, the forces of the lost motion spring 60 and valve spring 62, which are exerted on the control shaft 40, are oriented in the same rotation direction. Each cylinder is provided with one lost motion spring 60 and two valve springs 62. Therefore, the loads applied by these springs are imposed on the control shaft 40, which is shared by the cylinders.

Therefore, when, for instance, the control shaft 40 is made of a thin, hollow pipe, the forces of the lost motion spring 60 and valve spring 62 distort the control shaft 40, thereby causing the control shaft 40 to deform in the direction of rotation. In such an instance, the control shaft 40 is locked by the worm gear mechanism to prevent it from rotating. The rigidity of the control shaft 40 decreases with an increase in the distance from the worm gear mechanism. Therefore, the amount of control shaft deformation increases with an increase in the distance from the worm wheel 72.

As such being the case, the second embodiment is configured so that the force of the assist spring 64 increases with an increase in the distance from the worm wheel 72. In other words, when the forces of the assist springs 64 for cylinders #1 to #4, which are shown in FIG. 9, are P#1 to P#4, the forces of the assist springs 64 are set up so that P#1>P#2>P#3>P#4. The forces of the assist springs 64 can be changed by causing the assist springs 64 to differ, for instance, in the wire diameter, the number of turns, and the coil diameter. The forces of the assist springs 64 can also be changed by installing the assist springs 64 for the cylinders at different mounting angles and without having to change the designs of the assist springs 64.

The assist spring 64 generates a force that resists the forces of the lost motion spring 60 and valve spring 62. Therefore, when the force of the assist spring 64 is increased for parts that are positioned away from the worm wheel 72 and low in rigidity in relation to deformation in the rotation direction, the torsion of the control shaft 40 can be controlled. It is then possible to prevent the valve discs 12 in the cylinders from varying in the lift amount and valve opening/closing timing due to control shaft deformation. To control the deformation of the control shaft 40, the load applied by the lost motion spring 60 may be varied from one cylinder to another to ensure that the force of the lost motion spring 60 decreases with an increase in the distance from the worm wheel 72.

In the example shown in FIG. 9, a worm mechanism is provided at the end of the control shaft 40 for a four-cylinder engine. However, even when the worm mechanism is positioned between cylinders #2 and #3, the deformation of the control shaft 40 can be controlled by causing the force of the assist spring 64 to increase with an increase in the distance from the worm mechanism.

In the second embodiment, the assist spring 64 is provided to apply a force in opposition to the forces of the lost motion spring 60 and valve spring 62 as described above. This makes it possible to considerably reduce the driving force for rotating the control shaft 40 as is the case with the first embodiment. Further, the force of the assist spring 64 increases with an increase in the distance from the worm wheel 72, which regulates the rotation position of the control shaft 40. It is therefore possible to inhibit the control shaft 40 from being deformed by the load applied by the lost motion spring 60 and valve spring 62. Consequently, it is possible to inhibit the lift amount and operating angle of each cylinder from being varied and provide the same intake air amount for all cylinders. As a result, it is possible to avoid drivability deterioration and output decrease.

Further, the deformation of the control shaft 40 can be controlled. It is therefore possible to decrease the diameter and wall thickness of the control shaft 40. This makes it possible to decrease the drive torque of the motor 66 and reduce the size of the engine.

Figure 10:
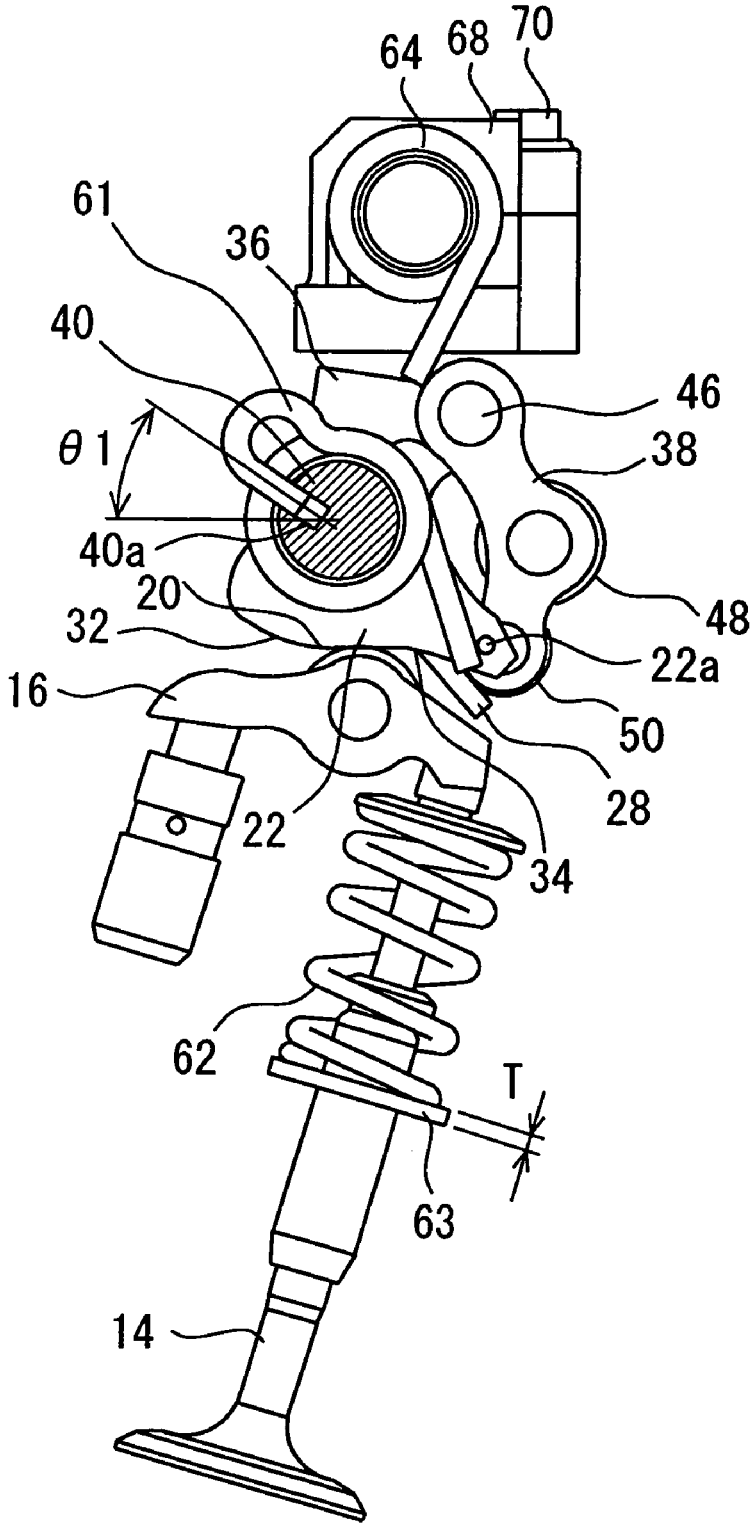
FIG. 10 is a schematic diagram illustrating a lost motion spring that is made of a torsion spring.

FIG. 10 is a schematic diagram illustrating the first/second embodiment in which a lost motion spring 61 made of a torsion spring is used instead of the lost motion spring 60 made of a coil spring.

In the configuration shown in FIG. 10, the lost motion spring 61 is positioned on the side of the oscillation arm 22 to penetrate through the control shaft 40. One end of the lost motion spring 61 is in engagement with a protrusion 22*a* that is provided on the side of the oscillation arm 22, and the other end is in engagement with an engagement section 40*a* that is provided on the control shaft 40.

The force of the lost motion spring 61 causes the oscillation arm 22 to lift up the roller contact surface 28 (works in the direction of rotating the oscillation arm 22 counterclockwise in FIG. 10). Therefore, the configuration shown in FIG. 10 permits the lost motion spring 61 to exercise the same function as the lost motion spring 60 that is made of a coil spring. In other words, the lost motion spring 61 ensures that the cam 54 is mechanically coupled to the roller contact surface 28 via the cam contact roller 48 and slide roller 50.

As described earlier, the second embodiment controls the deformation of the control shaft 40 by changing the force of the assist spring 64 in accordance with the distance from the worm wheel 72, which regulates the rotation position of the control shaft 40. However, the deformation of the control shaft 40 occurs due to the resultant force that the valve spring 62, lost motion spring 60, and assist spring 64 apply in the direction of control shaft rotation. Therefore, when the resultant force is varied in accordance with the distance from the worm wheel 72 on an individual cylinder basis, it is possible to inhibit the control shaft 40 from deforming. In other words, when the resultant force that the valve spring 62, lost motion spring 60, and assist spring 64 apply in the direction of control shaft rotation is decreased with an increase in the distance from the worm wheel 72, it is possible to inhibit the control shaft 40 from being deformed in the rotation direction by the forces of the springs.

More specifically, the deformation of the control shaft 40 can be controlled by changing the force of the lost motion spring 60 in accordance with the distance from the worm wheel 72, which regulates the rotation position of the control shaft 40. In such a situation, the force of the lost motion spring 60 in the variable valve mechanism 10 for each cylinder is set up so that the force of the lost motion spring 60 decreases with an increase in the distance from the worm wheel 72. As described earlier, the forces of the valve spring 62 and lost motion spring 60 are applied to the control shaft 40 and oriented in the same rotation direction. The amount of control shaft deformation by the forces of the valve spring 62 and lost motion spring 60 increases with an increase in the distance from the worm wheel 72. Therefore, when the force of the lost motion spring 60 is decreased with an increase in the distance from the worm wheel 72, it is possible to control the torsion and other deformation of the control shaft 40.

The deformation of the control shaft 40 can also be controlled by changing the force of the valve spring 62 in accordance with the distance from the worm wheel 72, which regulates the rotation position of the control shaft 40. In such a situation, the force of the valve spring 62 for each cylinder is set up so that the force of the valve spring 62 decreases with an increase in the distance from the worm wheel 72. The amount of control shaft deformation by the forces of the valve spring 62 and lost motion spring 60 increases with an increase in the distance from the worm wheel 72. Therefore, the torsion and other deformation of the control shaft 40 can be controlled by causing the force of the valve spring 62 to decrease with an increase in the distance from the worm wheel 72.

The forces of the lost motion springs 60 for the cylinders can be varied by causing the lost motion springs 60 to differ, for instance, in the wire diameter, the number of turns, and the coil diameter. The forces of the lost motion springs 60 can also be varied by configuring the lost motion spring mount in such a manner that the amount of lost motion spring compression varies from one cylinder to another. When the lost motion springs 61 are made of a torsion spring as indicated in FIG. 10, the forces of the lost motion springs 61 can be varied by variously setting the angle between the horizontal and the extension direction of the engagement section 40*a* (this angle is indicated by the symbol θ1 in FIG. 10). More specifically, referring to the FIG. 10, the force of the lost motion spring 61 works to rotate the oscillation arm 22 counterclockwise. Therefore, when the value of the angle θ1, which indicates the position of the engagement section 40*a* that engages with each lost motion spring 61, is increased with an increase in the distance from the worm wheel 72 as viewed in the length direction of the control shaft 40, it is possible to ensure that the force of the lost motion spring 61 decreases with an increase in the distance from the worm wheel 72. When the position of the engagement section 40*a* is varied as described above, it is possible to vary the forces of the lost motion springs 61 without changing the designs of the lost motion springs 61. When the amount of lost motion spring compression is varied from one cylinder to another or when the position of the engagement section 40*b* is varied, it is not necessary to furnish a plurality of lost motion springs 60, 61 that vary in the force. Consequently, the number of parts can be reduced. Further, when the lost motion springs 60, 61 are to be installed, it is not necessary to perform a step for choosing from a plurality of lost motion springs 60, 61 that vary in the force.

Further, the forces of the valve springs 62 can be varied by causing the valve springs 62 to differ, for instance, in the wire diameter, the number of turns, and the coil diameter. The forces of the valve springs 62 can also be varied by inserting a valve spring sheet 63, which varies in thickness, underneath the valve springs 62 as indicated in FIG. 10. When, in this instance, the thickness of the valve spring sheet 63 is decreased with an increase in the distance from the worm wheel 72 as viewed in the length direction of the control shaft 40, it is possible to ensure that the force of the valve spring 62 decreases with an increase in the distance from the worm wheel 72. When the forces of the valve springs 62 are varied by using the valve spring sheet 63 as described above, the forces of the valve springs 62 can be varied without changing the designs of the valve springs 62. Therefore, it is not necessary to furnish a plurality of valve springs 62 that vary in the force. Consequently, the number of parts can be reduced. In addition, valve spring installation can be carried out without having to perform a step for choosing from a plurality of valve springs 62 that vary in the force.

When the force of at least one of the lost motion spring 60, valve spring 62, and assist spring 64 is varied in the length direction of the control shaft 40, and the resultant force that the valve spring 62, lost motion spring 60, and assist spring 64 apply in the direction of control shaft rotation is decreased with an increase in the distance from the worm wheel 72, it is possible to inhibit the control shaft 40 from being deformed in the direction of rotation by the forces of the springs.

Third Embodiment

A third embodiment of the present invention will now be described. The basic configuration and operation of the third embodiment of the variable valve mechanism 10 are the same as those of the first embodiment, which has been described with reference to FIGS. 1 to 4.

Figure 11A:
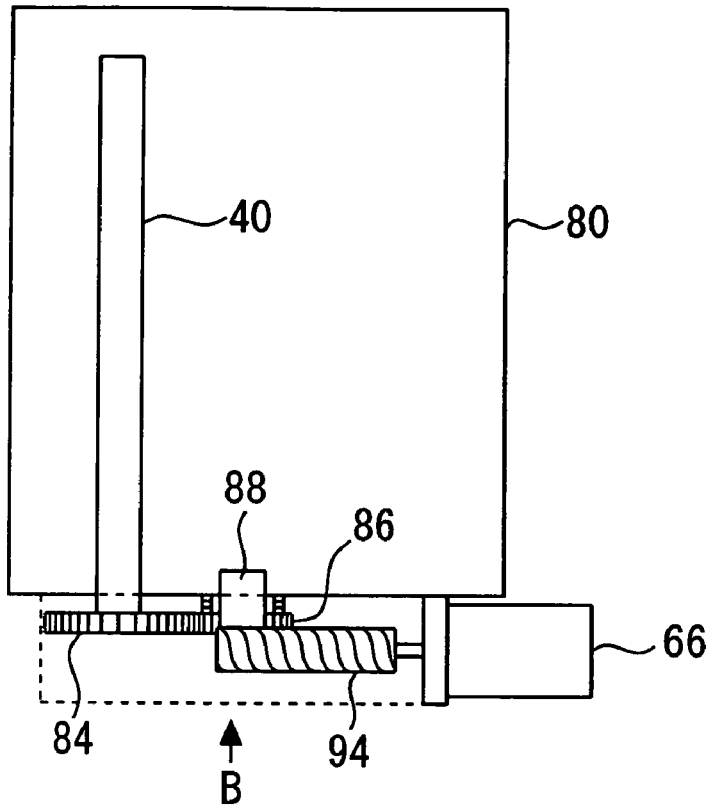
FIGS. 11A, 11B, and 11C illustrate the overall configuration of a variable valve mechanism according to a third embodiment of the present invention.
Figure 11B:
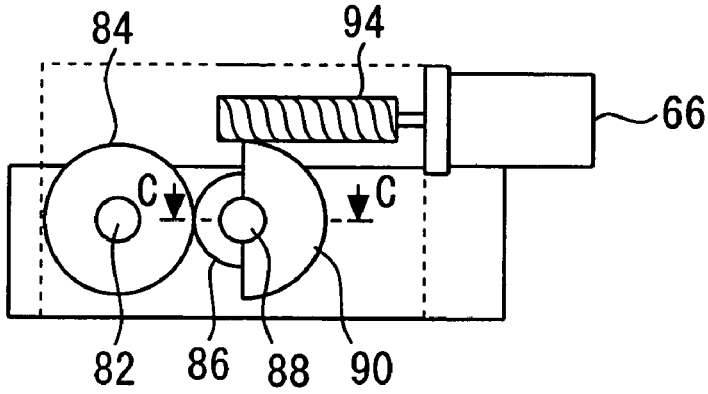
Figure 11C:
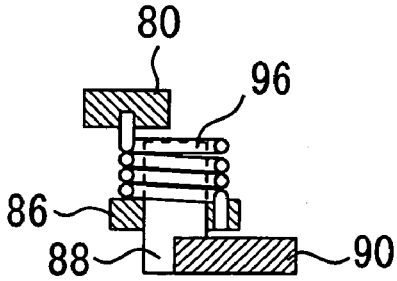

FIGS. 11A, 11B, and 11C illustrate the variable valve mechanism 10 according to the third embodiment. More specifically, FIG. 11A is a plan view illustrating the variable valve mechanism 10. FIG. 11B is a side view that is taken in the direction of arrow B in FIG. 11A to illustrate the variable valve mechanism 10. FIG. 11C is a cross-sectional view that is taken along section C—C of FIG. 11B to illustrate essential parts of the variable valve mechanism.

The configuration shown in FIGS. 11A, 11B, and 11C includes an internal combustion engine cylinder head 80. The cylinder head 80 retains the control shaft 40 via a control shaft bearing (not shown) and allows the control shaft 40 to rotate. The essential parts of the variable valve mechanism 10, which have been described with reference to FIGS. 1 and 2 and are not shown in FIGS. 11A, 11B, and 11C, are provided near the cylinder head 80. The internal combustion engine according to the present embodiment includes a plurality of in-line type cylinders (it is hereinafter assumed that the internal combustion engine according to the present embodiment includes four cylinders). The control shaft 40 is positioned over the four cylinders.

A first gear 84, which is a spur gear, is fastened to the end of the control shaft 40. A second gear 86, which is also a spur gear, is in engagement with the first gear 84. A rotation shaft 88 is fastened to the center of the second gear 86. As shown in FIG. 11B, a semicircular worm wheel 90 is fastened to the rotation shaft 88. The worm wheel 90 overlaps the second gear 86. The rotation shaft 88 is retained by the cylinder head 80 in a rotatable manner. When this configuration is employed, the semicircular worm wheel 90 and the second gear 86, which is shaped like a spur gear, can rotate on the rotation shaft 88 while the relative rotation angle between them is kept constant.

The motor 66, which functions as an actuator for rotating the control shaft 40, is mounted on the side of the cylinder head 80. A worm gear 94, which meshes with the aforementioned worm wheel 90, is fastened to a rotation shaft for the motor 66. As indicated in the figures, the lateral surface of the worm gear 94 is provided with a spiral gear groove. The worm wheel 90 is provided with an inclined gear groove that meshes with the spiral gear groove.

The rotation shaft for the motor 66 is positioned 90 degrees from the rotation shaft 88 for the worm wheel 90. The worm gear 94 and worm wheel 90 can transmit the output torque of the motor 92 to the rotation shaft 88 although their rotation shafts are not in alignment. Within the configuration shown in FIGS. 11A, 11B, and 11C, the torque transmitted to the rotation shaft 88 is transmitted to the control shaft 40 via the second gear 86 and first gear 84. Therefore, when this configuration is employed, the rotation of the control shaft 40 can be controlled by controlling the rotation of the motor 66.

In the variable valve mechanism according to the present embodiment, the rotation position of the control shaft 40 is adjusted within a predetermined angular range. Therefore, the gear mechanism connected to the control shaft 40 should be capable of operating the control shaft 40 within such an angular range. In the configuration according to the present embodiment, such an angular range can be sufficiently covered by rotating the worm wheel 90 through 180 degrees. In the present embodiment, therefore, the worm wheel 90 is shaped like a semicircle to minimize the unnecessary portion contained in the gear mechanism.

Further, the variable valve mechanism according to the present embodiment includes an assist spring 96, which is provided in the gear mechanism for transmitting the torque of the motor 66 to the control shaft 40. The assist spring 96 is made of a coil spring, which is positioned around the rotation shaft 88 for the worm wheel 90. One end of the assist spring 96 is fastened to the second gear 86 and the other end is fastened to the cylinder head 80.

The assist spring 96 can generate an assist torque around its central axis. In the configuration described above, the assist spring 96 can give a torque, which is oriented in a predetermined direction, to the second gear 86, rotation shaft 88, and worm gear 90. The rotation of the rotation shaft 88 is transmitted to the control shaft 40 so that the intake valve lift amount changes. When rotation in one direction occurs, the lift amount increases. When rotation in another direction occurs, the lift amount decreases. In the present embodiment, the assist spring 96 is installed so as to generate the assist torque in the direction of increasing the lift amount.

As described above, the variable valve mechanism according to the present embodiment is configured so that the motor 66 drives the control shaft 40 via the gear mechanism that includes the worm wheel 90 and worm gear 94. The gear mechanism incorporates the assist spring 96 for imparting an assist torque, which is oriented in the great lift direction, to the control shaft 40. Further, the assist torque is directly applied to the worm wheel 90.

When a combination of the worm wheel 90 and worm gear 94 is used, it is possible to provide high normal efficiency and low inverse efficiency. Therefore, the variable valve mechanism according to the present embodiment permits the torque generated by the motor 66 to be transmitted to the control shaft 40 with high efficiency. Further, the variable valve mechanism prevents the torque input to the control shaft 40 from being transmitted to the motor 66. Therefore, the variable valve mechanism can accurately control the rotation position of the control shaft 40 by controlling the motor 66.

In the variable valve mechanism according to the present embodiment, the influence of an external force for rotating the control shaft 40 in the small lift direction, that is, the influence of the reactive force of the valve spring 62 and the force exerted by the lost motion spring 60, can be mitigated with the aforementioned assist torque. If the control shaft 40 is to be rotated in the great lift direction in a situation where the assist torque does not exist, it is necessary to rotate the control shaft 40 in resistance to various mechanical friction forces, the reactive force of the valve spring 62, and the like. In this instance, it is demanded that the motor 66 generate a great torque. As a result, great electrical power is required for driving the motor 66, and the gear mechanism and control shaft 40 are likely to twist.

If, on the other hand, the influence of the reactive force of the valve spring 62 and the like can be mitigated with the assist torque, the control shaft 40 can be rotated in the great lift direction with a small motor torque. Consequently, when compared to a situation where the assist spring 96 does not exist, the variable valve mechanism according to the present embodiment is advantageous in that it, for example, reduces the size of the motor 66, decreases the power consumption for driving the control shaft 40, and reduces the torsion of the control shaft and the like.

Figure 12:
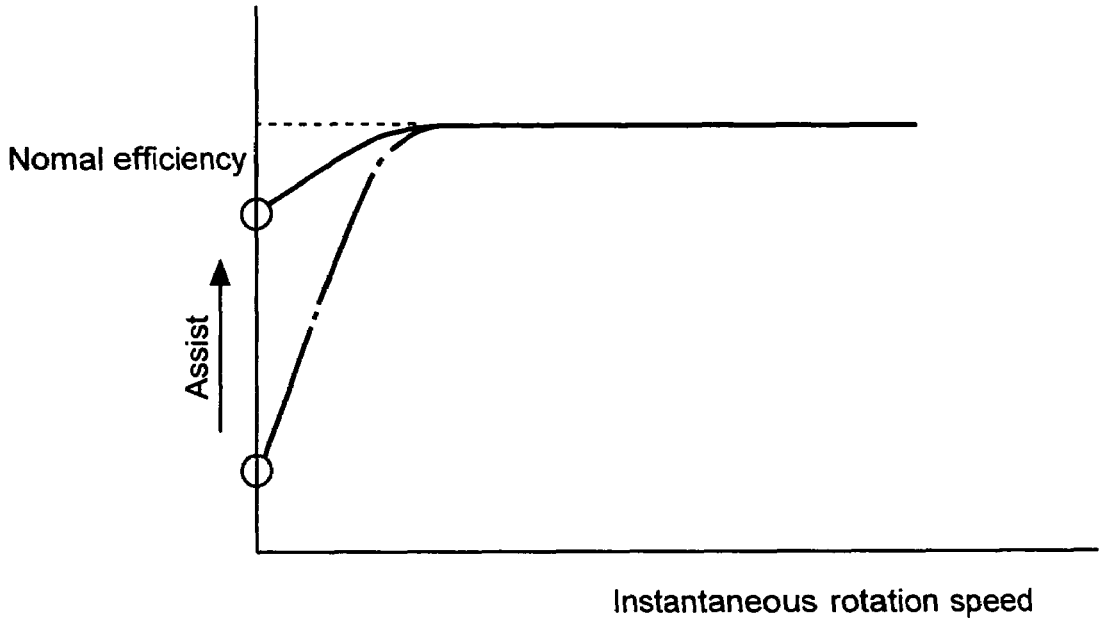
FIG. 12 illustrates the relationship between the normal efficiency of a gear mechanism, which comprises a worm gear and worm wheel, and their instantaneous rotation speed.

Further, the configuration according to the present embodiment permits the control shaft 40 in a stationary state to smoothly start rotating because the assist torque is directly applied to the worm wheel 90. The reason will now be described with reference to FIG. 12. FIG. 12 illustrates the relationship between the normal efficiency of the gear mechanism (the efficiency of torque transmission from the worm gear 94 to the worm wheel 96), which comprises the worm gear 94 and worm wheel 90, and their instantaneous rotation speed. More specifically, the curve indicated by a one-dot chain line in FIG. 12 represents the normal efficiency that prevails when the assist torque is not applied to the worm wheel 90. The curve indicated by a solid line in FIG. 12 represents the normal efficiency that prevails when the assist torque, which is oriented in the direction of providing rotation assistance, is applied to the worm wheel 90.

The coefficient of static friction between the worm gear 94 and worm wheel 90 is sufficiently greater than the coefficient of static friction between the spur gears. If the motor 66 generates a torque that is oriented in the great lift direction while a force oriented in the small lift direction is applied to the control shaft 40, a great load is imposed between the worm gear 94 and worm wheel 90 due to the combination of the forces. Therefore, if the assist torque does not exist between the worm gear 94 and worm wheel 90, a great static friction force arises. As a result, the normal efficiency is remarkably low in a region where the instantaneous rotation speed is near zero, as indicated by a one-dot chain line in FIG. 12. When the instantaneous rotation speed is increased to avert the influence of the static friction coefficient, the normal efficiency steadily remains high.

When an assist torque oriented in the great lift direction is applied to the worm wheel 90, the force that is oriented in the small lift direction and input to the control shaft 40 can be offset by the assist torque. As a result, the static load imposed between the worm wheel 90 and worm gear 94 can be rendered small. When the load is small, the static friction arising between the worm wheel 90 and worm gear 94 is also small. Consequently, the normal efficiency within a low instantaneous rotation speed range is remarkably improved as indicated by a solid line in FIG. 12. When the normal efficiency in such a range is improved, the control shaft 40 smoothly begins rotating in the great lift direction. Thus, the control accuracy of the control shaft 40 increases.

As described above, the assist spring 96 in the variable valve mechanism according to the present embodiment permits the control shaft 40 to smoothly rotate in the great lift direction with a small motor torque. Further, an external force, which is oriented in the small lift direction, is originally applied to the control shaft 40. Thus, when the control shaft 40 is moved in the small lift direction, a good operation characteristic is inevitably achieved. In the variable valve mechanism according to the present embodiment, therefore, the control shaft 40 can be smoothly rotated in any direction even when a small force is applied.

The third embodiment, which has been described above, assumes that the assist spring 96 is incorporated in the gear mechanism for rotating the control shaft 40 in order to change the operating angle and lift amount of the valve disc 12. However, the present invention is not limited to such a configuration. More specifically, a mechanism for changing the operating angle and lift amount of the valve disc 12 by moving the control shaft 40 in axial direction may be employed so that an assist spring for generating an assist torque in the great lift direction is incorporated in a gear mechanism for transmitting a driving force to the control shaft 40.

As is the case with the first embodiment, the third embodiment, which has been described above, assumes that the lost motion spring 60 and valve spring 62 both generate a force for changing the variable valve mechanism 10 in the small lift direction. However, the present invention is not limited to such a configuration. The present invention is also applicable to a mechanism in which the lost motion spring generates a force in the great lift direction.

The third embodiment, which has been described above, assumes that the variable valve mechanism 10 changes both the operating angle and lift amount in accordance with the rotation position of the control shaft 40. However, the present invention is not limited to such a configuration. More specifically, the variable valve mechanism may change either the operating angle or lift amount. In such a situation, the same advantages are obtained as in the third embodiment when an assist spring is provided to generate a force for moving the control shaft, which changes only the valve disc operating angle, in the great operating angle direction or generate a force for moving the control shaft, which changes only the valve disc lift amount, in the great lift direction.

In the third embodiment, which has been described above, the first arm member 24 and second arm member 26 correspond to the "adjustment mechanism" according to the seventh aspect of the present invention; the motor 66 corresponds to the "actuator" according to the seventh aspect of the present invention; the worm gear 94, worm wheel 90, second gear 86, and first gear 84 correspond to the "gear mechanism" according to the seventh aspect of the present invention; and the assist spring 96 corresponds to the "assist force generation means" according to the seventh aspect of the present invention.

When, as is the case with the second embodiment, the third embodiment varies the force of the lost motion spring 60 or valve spring 62 in the length direction of the control shaft 40, and ensures that the resultant force applied in the direction of control shaft rotation by the valve spring 62 and lost motion spring 60 decreases with an increase in the distance from the first gear 84, it is possible to inhibit the control shaft 40 from being deformed in the rotation direction by the forces of the springs. For example, when the force of the lost motion spring 60 decreases with an increase in the distance from the first gear 84, it is possible to control the torsion of the control shaft.

Fourth Embodiment

Figure 13B:
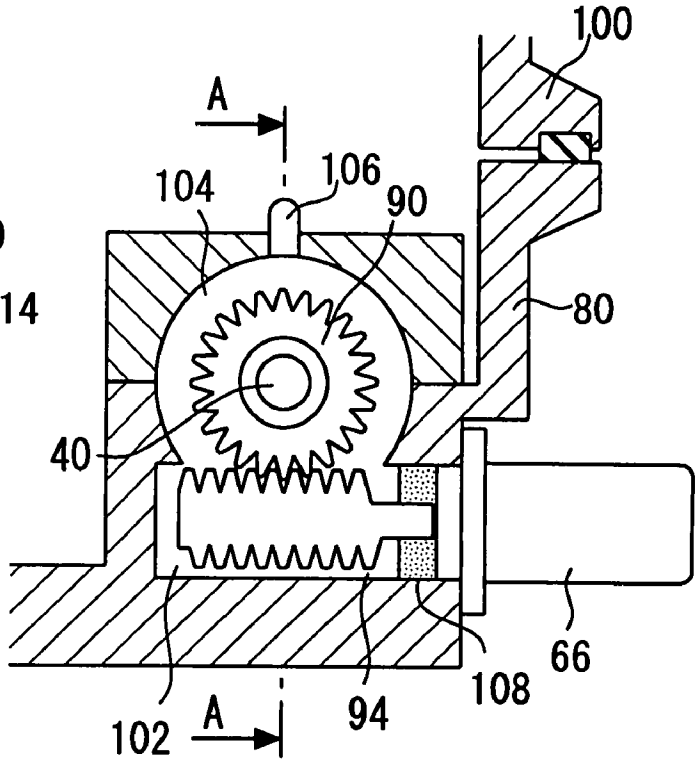
FIGS. 13A and 13B illustrate a lubricating oil flow path that is used in a variable valve mechanism according to a fourth embodiment of the present invention.
Figure 13A:
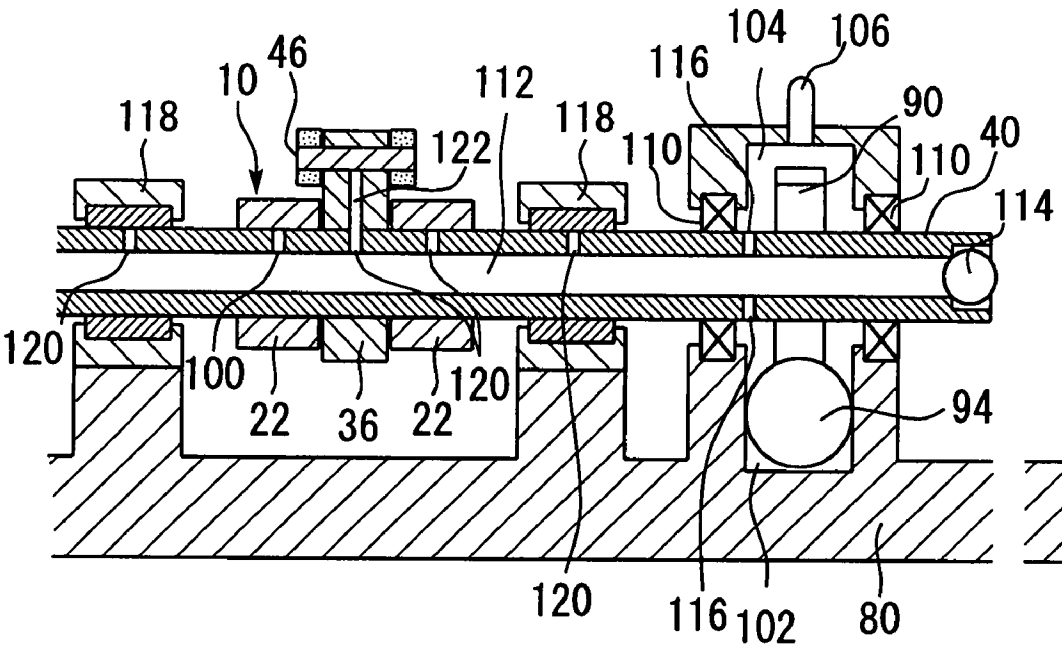

A fourth embodiment of the present invention will now be described with reference to FIGS. 13A and 13B. FIGS. 13A and 13B illustrate a lubricating oil flow path that is used in a variable valve mechanism according to the fourth embodiment of the present invention. More specifically, FIG. 13B is an enlarged cross-sectional view illustrating the engagement between the worm gear 94 and worm wheel 90. FIG. 13A is a cross-sectional view that is taken along section A—A of FIG. 13B to illustrate the variable valve mechanism according to the present embodiment. It is assumed that FIGS. 13A and 13B indicate the up-down positional relationship that prevails when the internal combustion engine is mounted in a vehicle.

The variable valve mechanism according to the present embodiment is substantially the same as the variable valve mechanism according to the third embodiment except that the former includes a lubricating oil flow path, which is described below. For the sake of convenience, the variable valve mechanism according to the present embodiment is configured so that the worm wheel 90 is fully circular and directly fastened to the control shaft 40. However, such a configuration is not essential to the present invention. The mechanism according to the present embodiment is characterized by the fact that it includes a lubricating oil flow path, which is described below. Elements that are shown in FIGS. 13A and 13B and similar to previously described elements are assigned the same reference numerals as the previously described elements and will be briefly described or will not be described at all.

As shown in FIG. 13B, the motor 66 in the variable valve mechanism according to the present embodiment is fastened to the cylinder head 80. The internal space of the cylinder head 80 is hermetically sealed by a head cover 100, which is installed over the internal space. A space 102 that is shaped to match the outline of the worm gear 94 and a space 104 that is shaped to match the outline of the worm wheel 90 are formed within the cylinder head 100. These spaces 102 and 104 are integral with each other. The worm gear 94 and worm wheel 90 are housed economically in these spaces.

The top of space 104 in which the worm wheel 90 is housed communicates with an oil supply path 106. The oil supply path 106 is used during an internal combustion engine operation so that lubricating oil forcibly fed from an oil pump is partly introduced into spaces 102 and 104. An oil seal 108 is installed over the rotation shaft of the motor 66 to surround the rotation shaft and isolate space 102 from the external space. Further, as indicated in FIG. 13A, another oil seal 110 is installed over the control shaft 40 to surround the control shaft 40 and isolate spaces 102 and 104 from the external space. Therefore, spaces 102 and 104 are filled with the lubricating oil during an internal combustion engine operation.

As shown in FIG. 13A, an oil flow path 112, which is extended in axial direction, is formed inside the control shaft 40. The end of the oil flow path 112 is sealed with a seal plug 114. The control shaft 40 is provided with an oil supply hole 116, which permits the oil flow path 92 to communicate with spaces 102 and 104. During an internal combustion engine operation, therefore, the lubricating oil, which fills spaces 102 and 104, is supplied to the oil flow path 112 via the oil supply hole 116.

The cylinder head 80 includes bearings 118. The bearings 118 are provided on both sides of the internal combustion engine cylinders to retain the control shaft 40. The control shaft 40 is retained by these bearings 118 in a rotatable manner. Essential parts of the variable valve mechanism 10, which correspond to each cylinder, are installed over the control shaft 40 at a position that is sandwiched between two bearings 118. More specifically, the two oscillation arms 22 and one non-oscillation section 36, which are included in the variable valve mechanism 10, are installed over the control shaft 40 at a position that is sandwiched between the two bearings 118.

The control shaft 40 is provided with an oil supply hole 120, which is connected to the oil flow path 112. The oil supply hole 120 is provided at a position that corresponds to each bearing 118, each oscillation arm 22, and each non-oscillation section 36. The non-oscillation section 36 is provided with an oil flow path 122. One end of this oil flow path 122 is connected to the oil supply hole 120 and the other end is connected to the side of the rotation shaft 46 of the oscillation roller section 38. Therefore, the lubricating oil flowing inside the control shaft 40 is supplied to each lubricating point via the oil supply hole 120, oil flow path 122, and the like.

The lubricating oil flowing to the oil flow path 112 of the control shaft 40 from spaces 102 and 104 in the variable valve mechanism according to the present embodiment is subsequently collected in an oil basin inside the internal combustion engine via various lubricating points and the like. When the internal combustion engine stops to shut off the new lubricating oil supply to spaces 102 and 104 from the oil supply path 106, the lubricating oil flow to the oil flow path 112 stops in the course of time, thereby terminating the lubrication oil circulation.

As regards the lubricating oil flow path shown in FIGS. 13A and 13B, the lubricating oil flowing into spaces 102 and 104 does not flow out of spaces 102 and 104 until it passes through the oil supply hole 116 and flows to the oil flow path 112. The oil supply hole 116 is positioned higher than the engagement between the worm gear 94 and worm wheel 90. Therefore, the lubricating oil level within spaces 102 and 104 is maintained at a position higher than the engagement between the worm gear 94 and worm wheel 90 even while the internal combustion engine is stopped.

Under the above conditions, the lubricating oil can always be supplied abundantly between the worm gear 94 and worm wheel 90. Even when the lubricating oil does not sufficiently circulate, for instance, immediately after internal combustion engine startup, the variable valve mechanism according to the present embodiment can transmit the output torque of the motor 66 efficiently to the control shaft 40.

INDUSTRIAL APPLICABILITY

As described above, the variable valve mechanism according to the present invention makes it possible to reduce the drive load on the control shaft that changes the valve disc lift amount and operating angle. It can be effectively used to exercise various variable valve mechanism functions within an internal combustion engine.

The invention claimed is:

1. A variable valve mechanism for changing lift amount and operating angle of an internal combustion engine valve disc, the variable valve mechanism comprising:

a first cam, which rotates in accordance with crankshaft rotation;

a transmission member that includes a second cam, which oscillates in synchronism with the rotation of the first cam and transmits a force exerted by the first cam to the valve disc;

a control shaft, which is adjusted for a predetermined rotation position, the control shaft having the transmission member pivotally engaged thereon;

an adjustment mechanism for varying the lift amount and operating angle of the valve disc by changing an oscillation range of the transmission member in accordance with the rotation position of the control shaft;

a lost motion spring for pressing the transmission member toward the first cam to ensure that the transmission member remains coupled to the first cam; and an assist spring for pressing the transmission member in resistance to a force exerted by the lost motion spring.

2. The variable valve mechanism according to claim 1, wherein the lost motion spring presses the transmission member in a direction of changing the lift amount and operating angle of the valve disc from a great lift/great operating angle side to a small lift/small operating angle side; and wherein the force exerted on the transmission member by the assist spring increases with a decrease in the lift amount and operating angle of the valve disc.

3. The variable valve mechanism according to claim 1, further comprising a valve spring for pressing the valve disc toward the transmission member, wherein the assist spring presses the transmission member in resistance to the valve spring's force that is exerted on the transmission member via the valve disc.

4. The variable valve mechanism according to claim 3, further comprising:

an actuator for generating a driving force for changing the rotation position of the control shaft; and a gear mechanism that is positioned between the actuator and the control shaft;

wherein a plurality of the transmission members, which are provided for the valve discs of various cylinders, are coupled to the common control shaft;

wherein the force exerted by the lost motion spring, the force exerted by the assist spring, and the force exerted by the valve spring are transmitted in the rotation direction of the control shaft via the transmission member and the adjustment mechanism; and wherein the resultant force applied in the rotation direction of the control shaft by the lost motion spring, the assist spring, and the valve spring decreases with an increase in the distance from the gear mechanism as viewed in a length direction of the control shaft.

5. The variable valve mechanism according to claim 4, wherein a force exerted on the transmission member by the assist spring increases with an increase in the distance from the gear mechanism as viewed in the length direction of the control shaft.

6. The variable valve mechanism according to claim 4, wherein the force exerted on the transmission member by the lost motion spring decreases with an increase in the distance from the gear mechanism as viewed in the length direction of the control shaft.

7. A variable valve mechanism, which is capable of changing operating angle and/or lift amount of an internal combustion engine valve disc, the variable valve mechanism comprising:

a control shaft whose status is controlled to change the operating angle and/or lift amount;

an oscillation arm that is positioned between a cam and the valve disc to oscillate in synchronism with cam rotation and transmit a force exerted by the cam to the valve disc, the oscillation arm pivotally engaged on the control shaft;

an adjustment mechanism for changing a basic relative angle of the oscillation arm relative to the valve disc in accordance with a status of the control shaft;

an actuator for generating a driving force for changing the status of the control shaft;

a gear mechanism that is positioned between the actuator and the control shaft; and assist force generation means for applying an assist force to the gear mechanism in order to increase the operating angle and/or lift amount.

8. The variable valve mechanism according to claim 7, wherein the gear mechanism includes a worm wheel and a worm gear, which are interconnected so as to position the worm gear toward the actuator and the worm wheel toward the control shaft; and wherein the assist force is applied to the worm wheel or to a structure integral with the worm wheel.

9. The variable valve mechanism according to claim 7, further comprising a lost motion spring for pressing the oscillation arm toward the cam to ensure that the oscillation arm remains mechanically coupled to the cam, wherein the oscillation arm moves in a direction of increasing the amount of lost motion spring deformation when the generation of a great operating angle and/or lift amount is requested.

10. The variable valve mechanism according to claim 9, wherein a plurality of the oscillation arms provided for the valve discs of various cylinders are coupled to the common control shaft; and wherein the force exerted by the lost motion spring decreases with an increase in the distance from the gear mechanism as viewed in a length direction of the control shaft.

11. A variable valve mechanism for changing lift amount and operating angle of an internal combustion engine valve disc, the variable valve mechanism comprising:

a first cam, which rotates in accordance with crankshaft rotation;

a transmission member that includes a second cam, which oscillates in synchronism with the rotation of the first cam and transmits a force exerted by the first cam to the valve disc;

a control shaft, which is adjusted for a predetermined rotation position, the control shaft having the transmission member pivotally engaged thereon;

an adjustment mechanism for varying the lift amount and operating angle of the valve disc by changing an oscillation range of the transmission member in accordance with the rotation position of the control shaft;

a lost motion spring for pressing the transmission member toward the first cam to ensure that the transmission member remains coupled to the first cam; and an assist spring for generating a force that resists a force exerted by the lost motion spring.

* * * * *